US011109657B2

(12) United States Patent
Correll et al.

(10) Patent No.: US 11,109,657 B2
(45) Date of Patent: Sep. 7, 2021

(54) ROLLING LUGGAGE WITH MULTIPLE MODES OF CONVEYANCE

(71) Applicant: Eddie Bauer LLC, Bellevue, WA (US)

(72) Inventors: Mark Correll, Carnation, WA (US); Paul Fair, Denver, CO (US); Jesse Thompson, North Bend, WA (US); SooYoung Baik, Binh Duong Province (VN); Damien Huang, Seattle, WA (US)

(73) Assignee: EDDIE BAUER LLC, Bellevue, WA (US)

( * ) Notice: Subject to any disclaimer, the term of this patent is extended or adjusted under 35 U.S.C. 154(b) by 119 days.

(21) Appl. No.: 16/289,356

(22) Filed: Feb. 28, 2019

(65) Prior Publication Data

US 2019/0191840 A1 Jun. 27, 2019

Related U.S. Application Data

(63) Continuation-in-part of application No. 14/935,113, filed on Nov. 6, 2015, now abandoned.
(Continued)

(51) Int. Cl.
*A45C 13/26* (2006.01)
*A45C 5/14* (2006.01)
(Continued)

(52) U.S. Cl.
CPC ..... *A45C 13/262* (2013.01); *A45C 5/03* (2013.01); *A45C 5/14* (2013.01); *A45C 13/38* (2013.01);
(Continued)

(58) Field of Classification Search
CPC ..... A45C 13/262; A45C 5/03; A45C 5/14; A45C 13/38; A45C 13/385;
(Continued)

(56) References Cited

U.S. PATENT DOCUMENTS 5,048,649 A 9/1991 Carpenter et al.
5,499,426 A 3/1996 Hsieh
(Continued)

FOREIGN PATENT DOCUMENTS

ES 2402137 4/2013
GB 2385319 8/2003
(Continued)

OTHER PUBLICATIONS

Official Action with English Translation for Japan Patent Application No. 2017/525118, dated Oct. 23, 2019 7 pages.
(Continued)

*Primary Examiner* — Tri M Mai
(74) *Attorney, Agent, or Firm* — Sheridan Ross P.C.

(57) ABSTRACT

An article of rolling luggage is provided. The article has a retractable or collapsible handle that is convertible between a stored position and a first extended position of use. The handle is also rotatable about an axis such that the handle can be converted between a second extended position of use. The second extended position of use is characterized in that the luggage item may be provided such that a base portion of the item is substantially adjacent to and parallel with a ground surface. Various locking means to enable conversion between the stored position, first extended position of use and second extended position of use are also provided.

19 Claims, 17 Drawing Sheets

Related U.S. Application Data

(60) Provisional application No. 62/076,373, filed on Nov. 6, 2014, provisional application No. 62/799,640, filed on Jan. 31, 2019.

(51) Int. Cl.
*A45C 5/03* (2006.01)
*A45C 13/38* (2006.01)

(52) U.S. Cl.
CPC ..... *A45C 13/385* (2013.01); *A45C 2005/035* (2013.01); *A45C 2013/265* (2013.01); *A45C 2013/267* (2013.01)

(58) Field of Classification Search
CPC ..... A45C 2005/035; A45C 2013/265; A45C 2013/267
See application file for complete search history.

(56) References Cited

U.S. PATENT DOCUMENTS

| | | | | |
|---|---|---|---|---|
| 5,526,908 | A | 6/1996 | Wang | |
| 5,630,521 | A | 5/1997 | Waddell et al. | |
| 5,689,854 | A | 11/1997 | Wang | |
| 5,806,143 | A | 9/1998 | Tsai | |
| 5,893,196 | A | 4/1999 | Tserng | |
| 6,042,127 | A | 3/2000 | Rupolo | |
| 6,079,527 | A | 6/2000 | Kuo | |
| 6,116,390 | A | 9/2000 | Cohen | |
| 6,302,250 | B1 | 10/2001 | Sadow et al. | |
| 6,409,207 | B1 | 6/2002 | Kuo | |
| 7,549,520 | B1 | 6/2009 | Chen | |
| 8,118,145 | B1 | 2/2012 | Hamamy et al. | |
| 8,205,934 | B2 | 6/2012 | Homans | |
| 2006/0213735 | A1* | 9/2006 | Weinstein | A45C 5/14 190/18 A |
| 2007/0215424 | A1 | 9/2007 | Mitlteman | |
| 2008/0223678 | A1 | 9/2008 | Godshaw et al. | |
| 2010/0018821 | A1* | 1/2010 | Minaker | B62B 5/025 190/18 A |
| 2010/0320048 | A1 | 12/2010 | Boccard | |
| 2012/0228074 | A1 | 9/2012 | Osler | |
| 2012/0326470 | A1 | 12/2012 | Homans et al. | |
| 2013/0069397 | A1 | 3/2013 | Homans et al. | |
| 2014/0116829 | A1 | 5/2014 | Davis | |
| 2016/0128442 | A1 | 5/2016 | Correll | |

FOREIGN PATENT DOCUMENTS

| | | | |
|---|---|---|---|
| JP | H05-15405 | 1/1993 | |
| WO | WO 99/34703 | 7/1999 | |
| WO | WO-9934703 A1 * | 7/1999 | A45C 5/146 |
| WO | WO 2002/37999 | 5/2002 | |

OTHER PUBLICATIONS

Official Action with English Translation for Japan Patent Application No. 2017-525118, dated Jun. 2, 2020 6 pages.
International Search Report and Written Opinion for International (PCT) Patent Application No. PCT/US15/59550, dated Jan. 27, 2016, 9 pages.
Official Action for U.S. Appl. No. 14/935,113, dated Sep. 28, 2017 9 pages.
Official Action for U.S. Appl. No. 14/935,113, dated Mar. 30, 2018 11 pages.
Official Action for U.S. Appl. No. 14/935,113, dated Aug. 30, 2018 12 pages.
International Preliminary Report on Patentability for International (PCT) Patent Application No. PCT/US2015/059550, dated May 18, 2017 8 pages.

* cited by examiner 52
63
60
61
66
67
64b
54b
54d
71
79
70
77
78
80
81
82
75
76

52
63
60
61
66
67
64b
71
54b
79
54d
70
77
78
80
81
82
75
76

52
63
60
61
66
67
64b
70
71
54b
54d
77
78
79
80
81
82
75
76

52
63
60
61
66
67
64b
70
71
54b
54d
79
77
78
80
81
82
75
76

ROLLING LUGGAGE WITH MULTIPLE MODES OF CONVEYANCE

CROSS REFERENCE TO RELATED APPLICATIONS

This U.S. Non-Provisional patent application is a continuation-in-part of U.S. Nonprovisional application Ser. No. 14/935,113, filed Nov. 6, 2015, which claims the benefit of priority from U.S. Provisional Application Ser. No. 62/076,373, filed on Nov. 6, 2014, and this U.S. Non-Provisional patent application claims the benefit of priority from U.S. Provisional Application Ser. No. 62/799,640, filed Jan. 31, 2019, the entire disclosures of which are hereby incorporated by reference in their entireties.

FIELD OF THE INVENTION

The present invention relates generally to luggage. More specifically, the present invention relates to rolling luggage devices with multiple modes of conveyance or use, and features to enable the multiple modes.

BACKGROUND

Rolling luggage has become increasingly popular in recent years. A common configuration for this type of luggage includes a container or case portion that is generally rectangular in shape in which one or more articles can be stored for travel. The container is typically comprised of a base, side walls, ends, and a lid. A wheel assembly is commonly provided to allow the container to be rolled rather than carried. The wheel assembly generally includes a pair of wheels mounted at an interface of the base and one of the ends of the luggage. A telescoping handle assembly is generally provided attached to the base. The telescoping handle assembly has at least one, and usually two, telescoping posts that can extend from the top panel of the container, which are connected by a handle for wheeling the luggage.

Typically, such rolling luggage configurations are suitcases, which have substantially rigid sides and/or a substantially rigid lid, however suitcases can be heavy, and take up a large amount of storage space when not in use. Duffel bags are also popular because of their lightweight, flexible construction and ability to store a large quantity of items. In addition, the flexible material allows the duffel bag to be folded or crumpled for storage.

SUMMARY OF THE INVENTION

There exists a long felt and unmet need to provide a luggage handle for luggage devices that provides enhanced ease of use, assembly, and manufacture. The present disclosure provides an improved article of rolling luggage including duffel bags and the like. Although various embodiments contemplate providing handles as shown and described herein in combination with luggage, it will be recognized that the present invention is not limited to such uses or combinations.

Various embodiments of the present invention relate to rolling luggage devices. Rolling luggage devices include, but are not limited to various forms of luggage including rolling duffels, hard-shells, attaches, laptop cases, etc.

In one embodiment, an article of rolling luggage is provided, the article comprising a substantially rigid base portion comprising a first end and second end and a predetermined length provided between the first end and the second end. A first pair of wheels is connected to the base portion and proximal to the first end. A second pair of wheels is connected to the base portion and proximal to the second end. A retractable handle assembly is connected to the base portion for towing the article of rolling luggage. A substantially flexible cover portion formed of a deformable material is secured to the base portion, and a retractable handle assembly comprising a first portion and a second portion is interconnected at a hinge and the first and second portions are rotatable with respect to one another about the hinge. The retractable handle is convertible between a retracted position, a first position of use, and a second position of use, wherein in the first position of use said retractable handle extends out of and coplanar to at least a portion of the base portion, and wherein in the second position of use the retractable handle is provided at an angle with respect to the base portion.

In certain embodiments, a luggage device is provided with a handle member for grasping and towing the luggage device. In preferred embodiments, a luggage handle is provided, the handle comprising a telescoping or extendable member that extends between a stored position and an extended position, the extended position comprising a position of use for towing the luggage device. The present disclosure contemplates that handles of the present disclosure are telescoping or extendable, and also rotatable about an axis, such that the handle is adapted to tow, manipulate, or otherwise provide a force to the luggage item. In certain embodiments, the axis comprises an axis that extends substantially parallel to an axle of a pair of wheels on the device. The handle is rotatable or convertible between an extended position, wherein the handle extends substantially parallel to a planar portion of the base of the luggage item and is adapted for towing the device on two wheels, and a second extended position wherein the handle is provided at an angle to a planar portion of the base of the item. The second extended position enables towing and other manipulation of the base when the base is provided on four wheels and a base of the item is provided substantially parallel to and/or proximal to a floor or ground surface.

In various embodiments, the handle comprises first and second parallel elongate members, and a substantially perpendicular grasping member extending between the first and second parallel elongate members. Handle members of various embodiments of the present disclosure contemplate first and second actuation or control members. In certain embodiments, the handle member comprises a first actuation member for releasing the handle member and enables a telescoping action of the handle, the telescoping action comprising at least one of extending and retracting the handle member. In certain embodiments, a push-button is provided on the handle member, the push-button adapted for unlocking or releasing various components of the handle member to enable an extending or retracting operation of the handle member. The handle member further comprises a second actuation member for enabling a rotation of the handle member. In various embodiments, the second actuation member comprises a second push-button. In other embodiments, the second actuation member comprises a rotatable portion of the handle member, wherein rotation of the rotatable portion enables at least one of an unlocking and a rotation of the handle member between the first extended position and the second extended position.

U.S. Pat. No. 6,079,527 to Kuo, which is hereby incorporated by reference in its entirety, discloses a luggage device with a retractable handle comprising parallel retractable arms. Kuo provides rotating means for the arms to allow the arms to be rotated to a predetermined position and locked at that position. Kuo also provides locking assemblies including static elements, movable elements, and locking pins. Such features are contemplated for use with embodiments of the present disclosure. Kuo fails to disclose, however, various novel features of the present disclosure, including devices and systems for providing a handle in first and second extended positions for use in towing or manipulating a luggage device.

U.S. Pat. No. 5,630,521 to Waddell et al., which is hereby incorporated by reference in its entirety, provides a wheeled luggage device comprising a handle portion with collapsible rod members and wherein the handle portion can be provided in at least two angled positions. Waddell fails to disclose, however, various features of embodiments of the present disclosure including, for example, devices and features that enable a luggage item to be towed or manipulated in either a two-wheeled or four-wheeled configuration.

U.S. Pat. No. 5,526,908 to Wang, which is hereby incorporated by reference in its entirety, discloses a luggage device with a collapsible handle member. Wang discloses various push-button features for unlocking a movement of the handle member. Such features, and variations that would be recognized by one of skill in the art, are contemplated for use with various embodiments of the present disclosure.

U.S. Pat. No. 5,499,426 to Hsieh, which is hereby incorporated by reference in its entirety, provides various devices and means for unlocking or activating a retractable handle assembly. Such features are contemplated for use with various embodiments of the present disclosure.

In certain embodiments, a handle member for a luggage device is provided, the handle member comprising a grasping portion with first and second release or control mechanisms. In such embodiments, a grasping portion of a handle is provided wherein the grasping portion extends between two collapsible or telescoping elongate members. The grasping portion comprises a first release mechanism wherein at least a portion of the grasping portion is rotatable about an axis. A user may twist or rotate the grasping portion to enable activation of at least one of two modes of conveyance of an associate luggage item. The grasping portion further comprises a push-button as a second release mechanism. The combination of the first release mechanism and the second release mechanism enables a user-selection of one of at least two modes of conveyance for the handle. For example, in one embodiment, a rotation of the grasping portion in a first rotational direction enables traditional conveyance of an item of rolling luggage wherein the handle portion extends substantially parallel to a base portion of the item. Rotation of the grasping portion enables conveyance of the item wherein the handle portion is provided at an angle to the luggage item and wherein the luggage item is provided on four wheels with the base portion proximal to and substantially parallel to a floor or ground surface. In alternative embodiments, a grasping portion is provided with release mechanisms and wherein activation of a push-button without a rotation of the grasping portion enables extension of the handle member to a first position, and wherein activation of a push-button and rotation of the grasping portion enables extension of the handle member to a second position.

In various embodiments, luggage devices and handle portions for luggage devices are provided with control features for selectively enabling various movements of the handle portion based on user input. For example, in certain embodiments, handle portions are provided with a first control feature for enabling the extension or extraction of the handle portion from a stored, stowed, or collapsed position to an extended position of use for towing, pulling, or otherwise manipulating a luggage item. Additionally, the handle portions comprise a second control feature for selectively rotating the handle portion to a second extended position and wherein the second extended position comprises a position of use wherein the luggage device may be towed or otherwise manipulated while a base member of the luggage item is provided proximal to a ground surface and two pairs of wheels of the device are in contact with the ground surface. In such embodiments, control features comprise various moveable parts including, but not limited, moveable locking pins and similar release features that may be selectively activated and deactivated by a user-input. Such user-inputs include, but are not limited to, depression of a push-button provided on the handle portion, rotation of at least a portion of the handle portion, activation or movement of one of switches provided on the handle portion, and similar features and actions as will be recognized by one of ordinary skill in the art.

The Summary of the Invention is neither intended nor should it be construed as being representative of the full extent and scope of the present disclosure. The present disclosure is set forth in various levels of detail in the Summary of the Invention as well as in the attached drawings and the Detailed Description of the Invention and no limitation as to the scope of the present disclosure is intended by either the inclusion or non-inclusion of elements, components, etc. in this Summary of the Invention. Additional aspects of the present disclosure will become more readily apparent from the Detailed Description, particularly when taken together with the drawings.

BRIEF DESCRIPTION OF THE DRAWINGS

Those of skill in the art will recognize that the following description is merely illustrative of the principles of the disclosure, which may be applied in various ways to provide many different alternative embodiments. This description is made for illustrating the general principles of the teachings of this disclosure invention and is not meant to limit the inventive concepts disclosed herein.

The accompanying drawings, which are incorporated in and constitute a part of the specification, illustrate embodiments of the disclosure and together with the general description of the disclosure given above and the detailed description of the drawings given below, serve to explain the principles of the disclosures.

It should be understood that the drawings are not necessarily to scale. In certain instances, details that are not necessary for an understanding of the disclosure or that render other details difficult to perceive may have been omitted. It should be understood, of course, that the disclosure is not necessarily limited to the particular embodiments illustrated herein.

Figure 1:
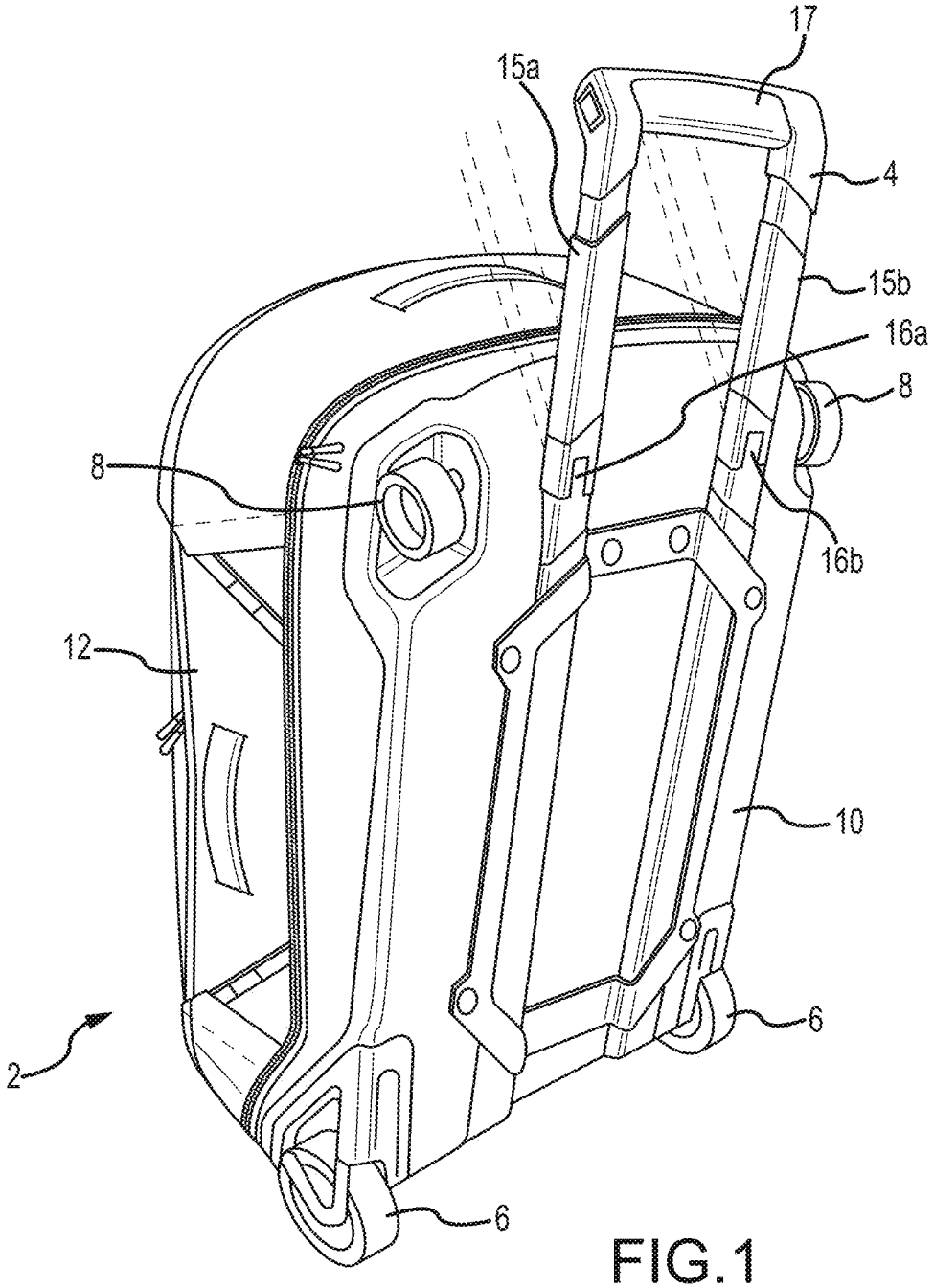

FIG. 1 is a perspective view of a luggage item according to one embodiment of the present disclosure in a first position of use.

Figure 2:
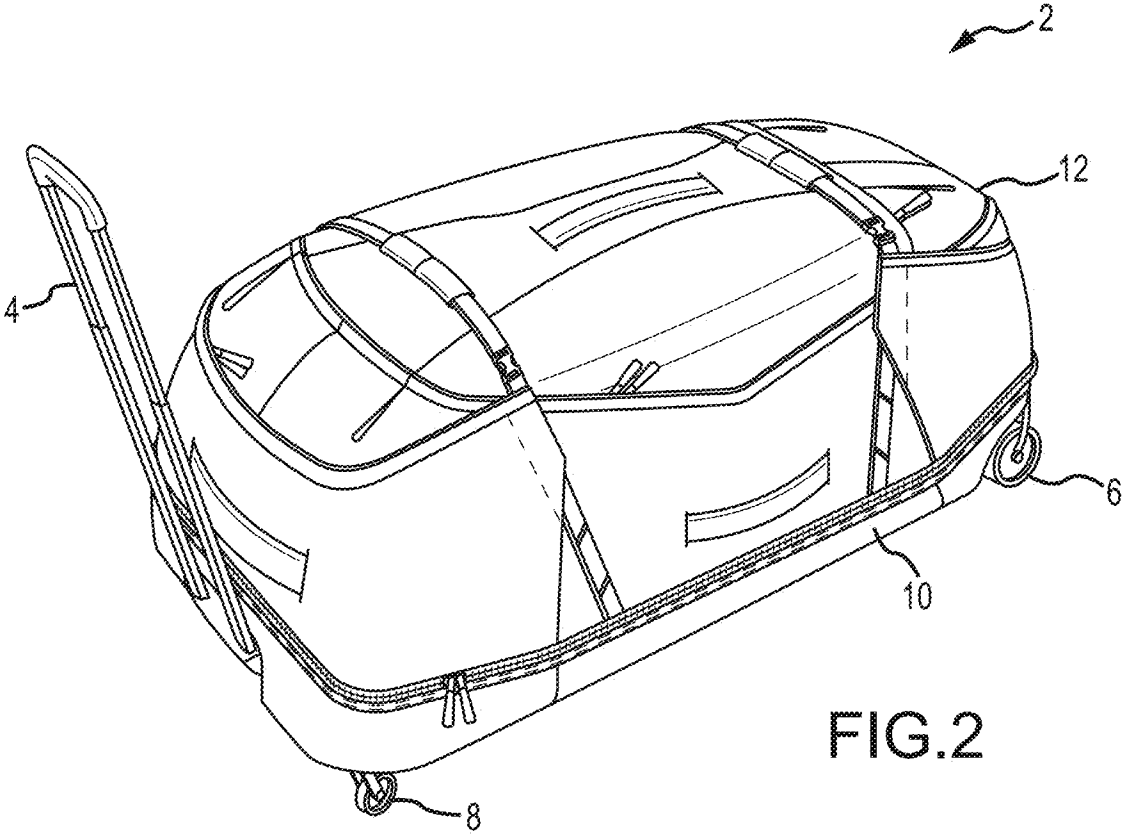

FIG. 2 is a perspective view of a luggage item according to one embodiment of the present disclosure in a second position of use.

Figure 3:
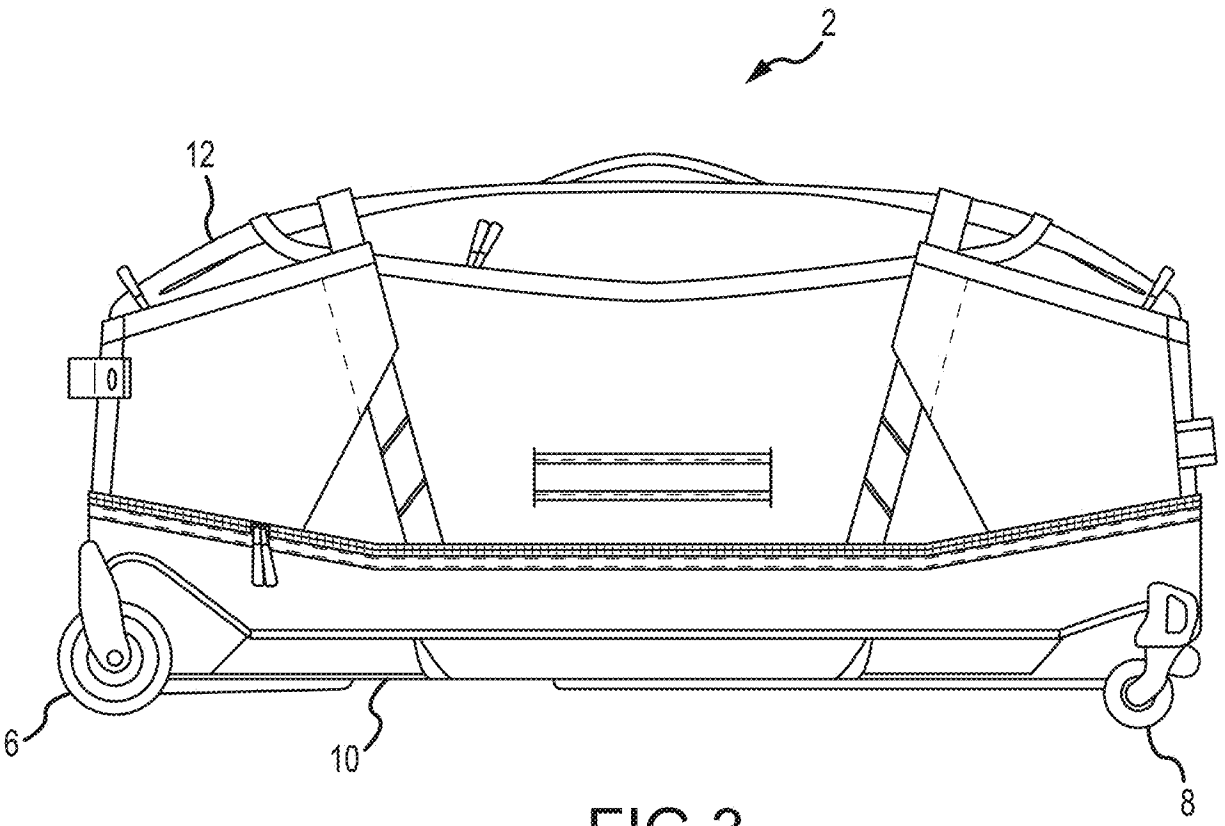

FIG. 3 is a side elevation view of a luggage item according to one embodiment of the present disclosure.

Figure 4:
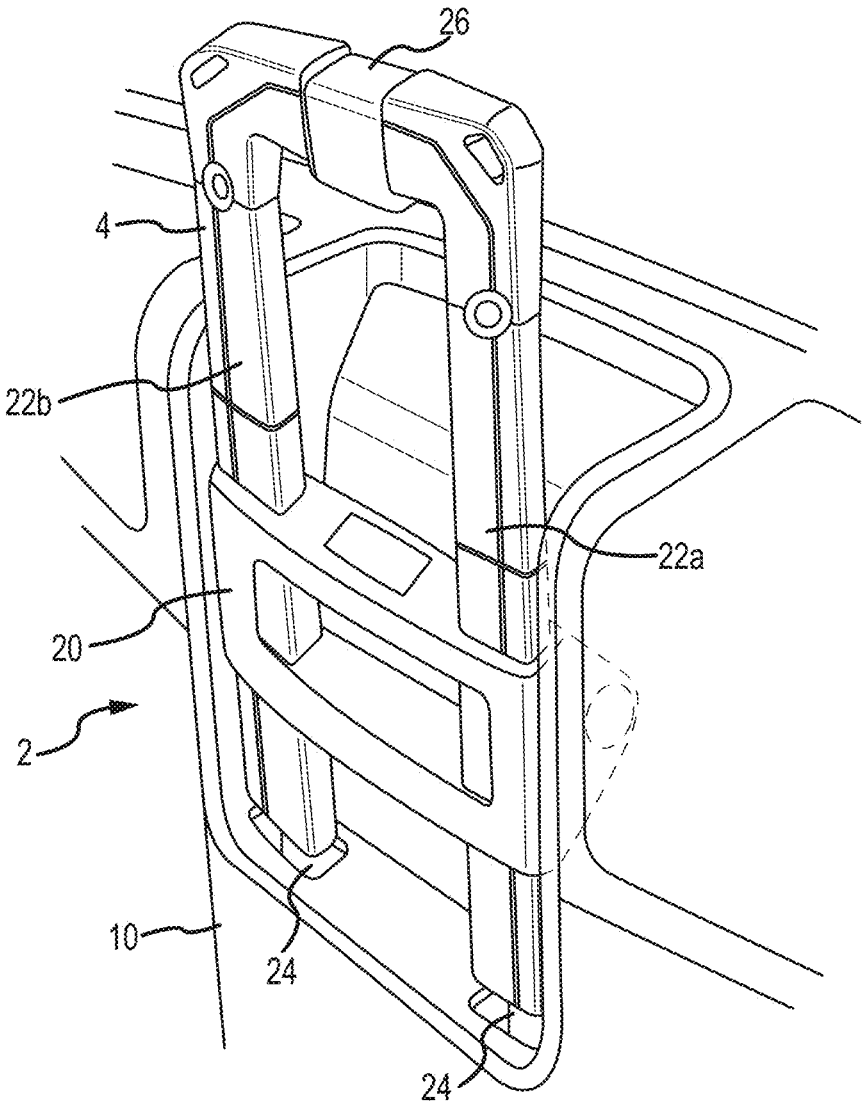

FIG. 4 is a perspective view of a component of a luggage item according to one embodiment of the present disclosure.

Figure 5:
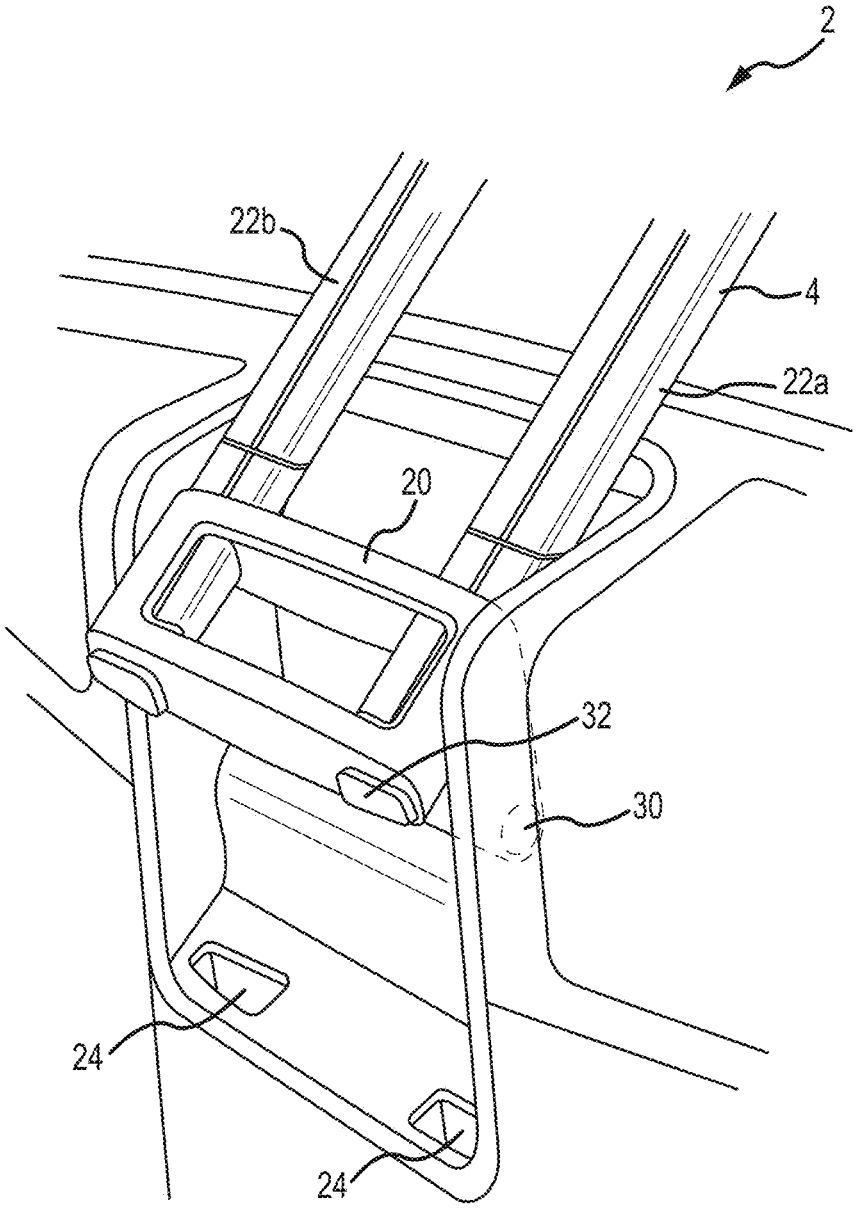

FIG. 5 is a perspective view of a component of a luggage item according to one embodiment of the present disclosure.

Figure 6B:
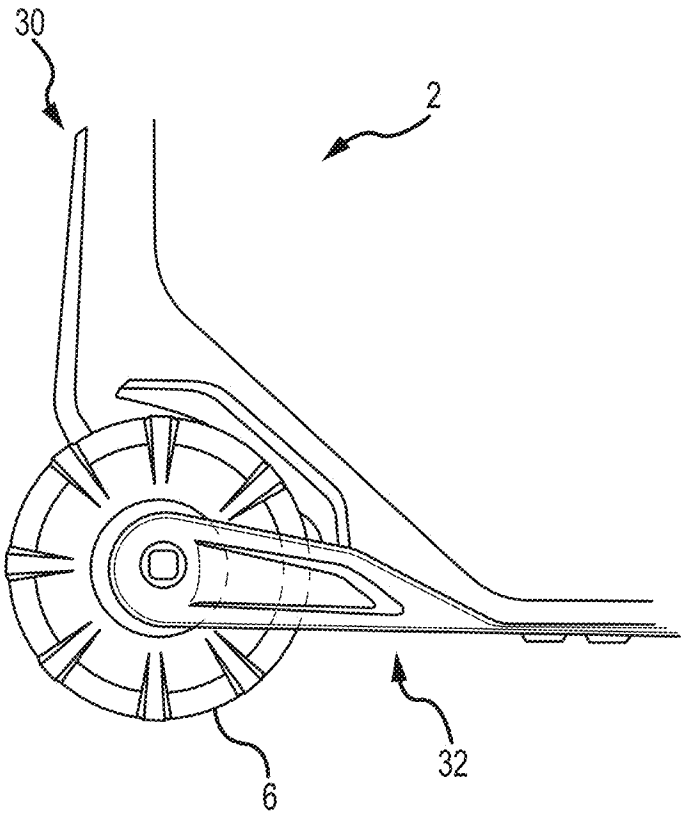
Figure 6A:
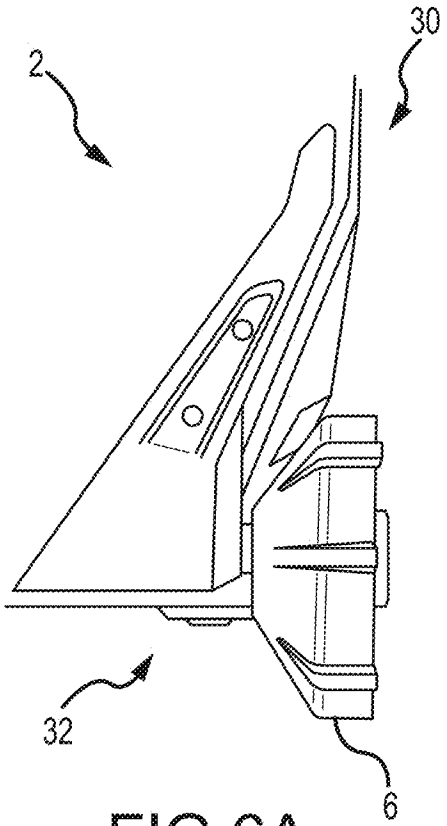

FIG. 6A is a front elevation view of a wheel assembly of a luggage item according to one embodiment of the present disclosure.

FIG. 6B is a side elevation view of a wheel assembly of a luggage item according to one embodiment of the present disclosure.

Figure 7:
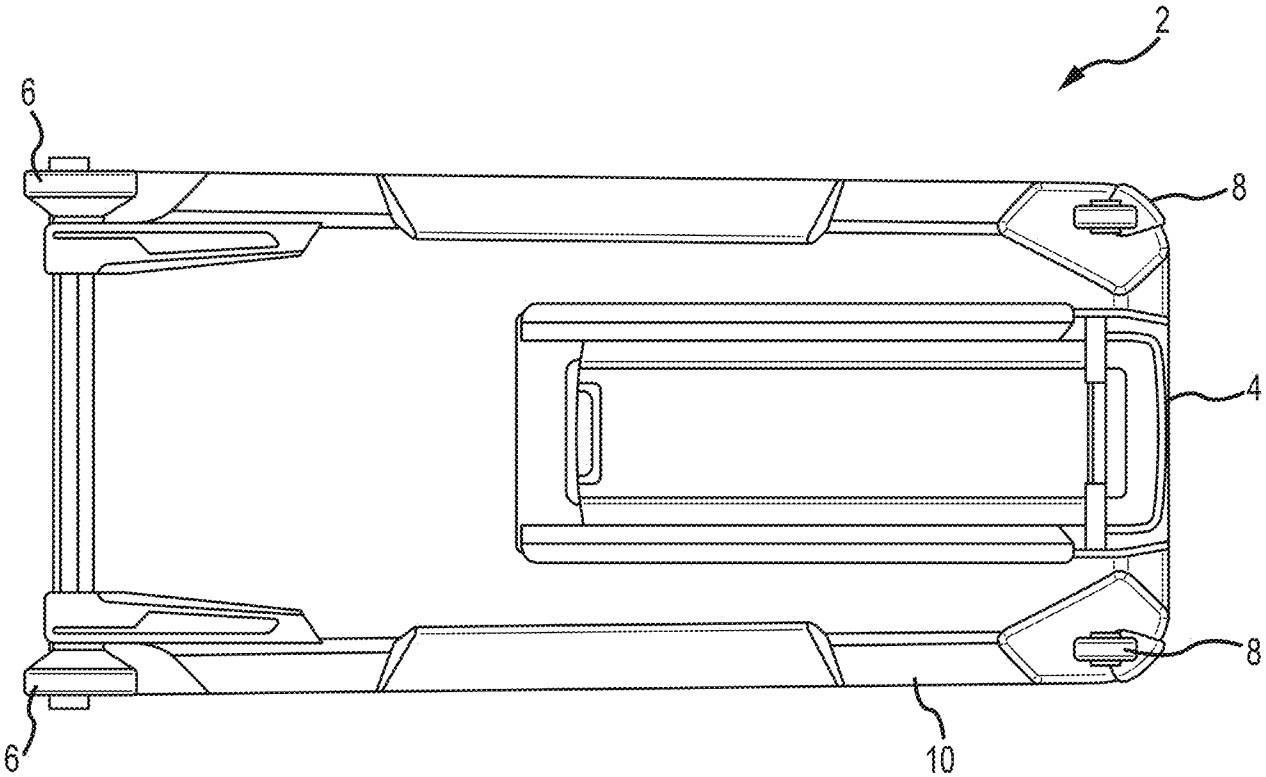

FIG. 7 is a rear elevation view of a luggage item according to one embodiment of the present disclosure.

Figure 8A:
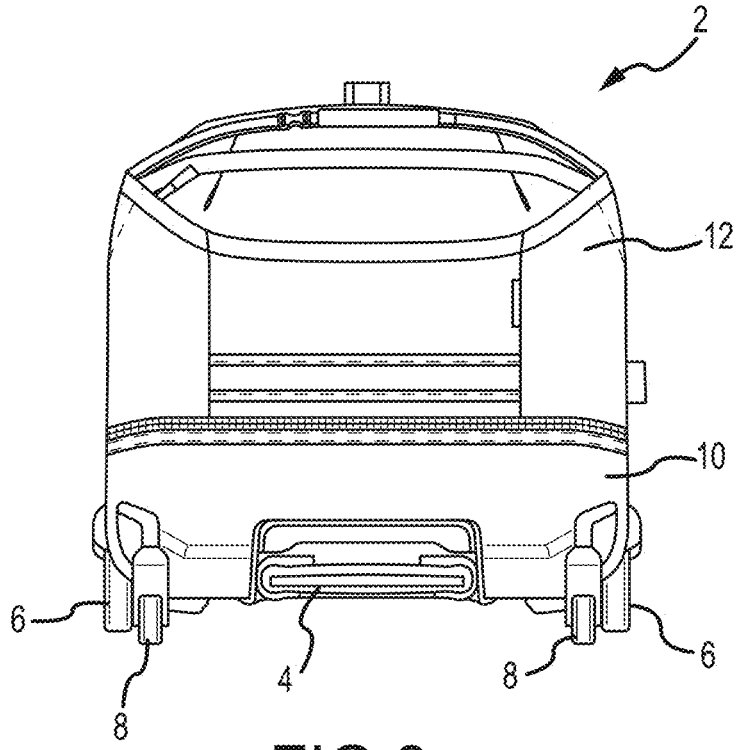

FIG. 8A is a left elevation view of a luggage item according to one embodiment of the present disclosure.

Figure 8B:
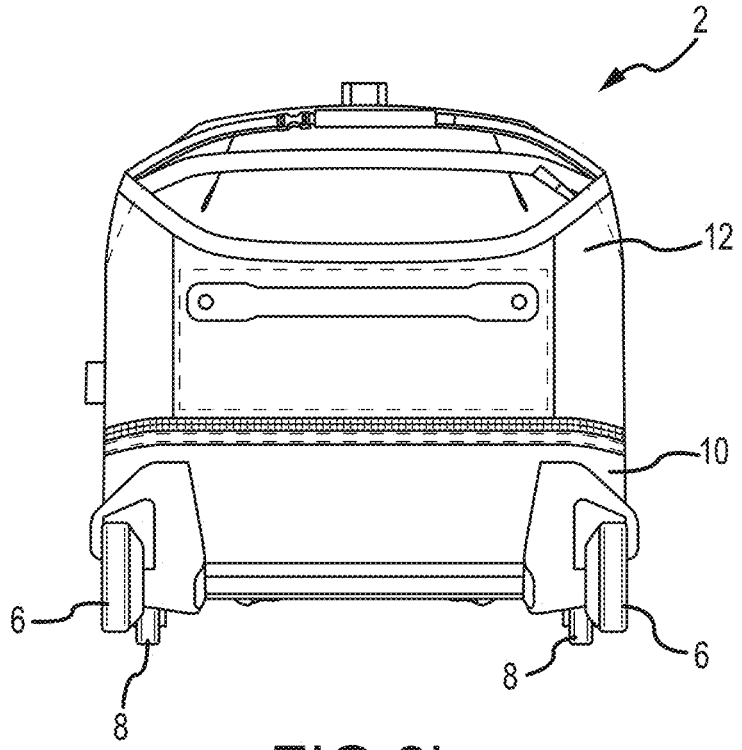

FIG. 8B is a right elevation view of a luggage item according to one embodiment of the present disclosure.

Figure 9:
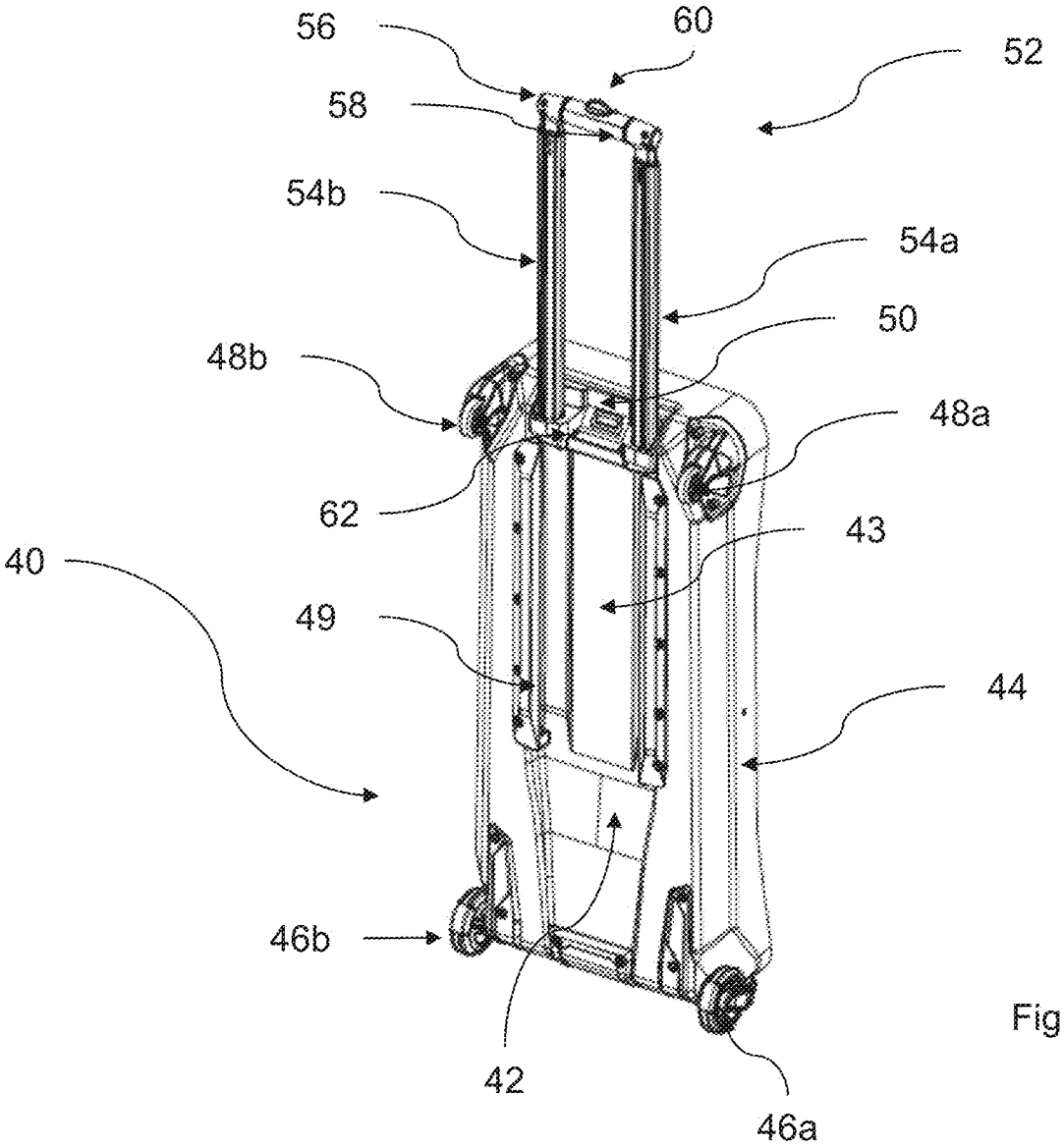

FIG. 9 is a perspective view of a handle portion and a base portion of a luggage item according to one embodiment of the present disclosure.

Figure 10:
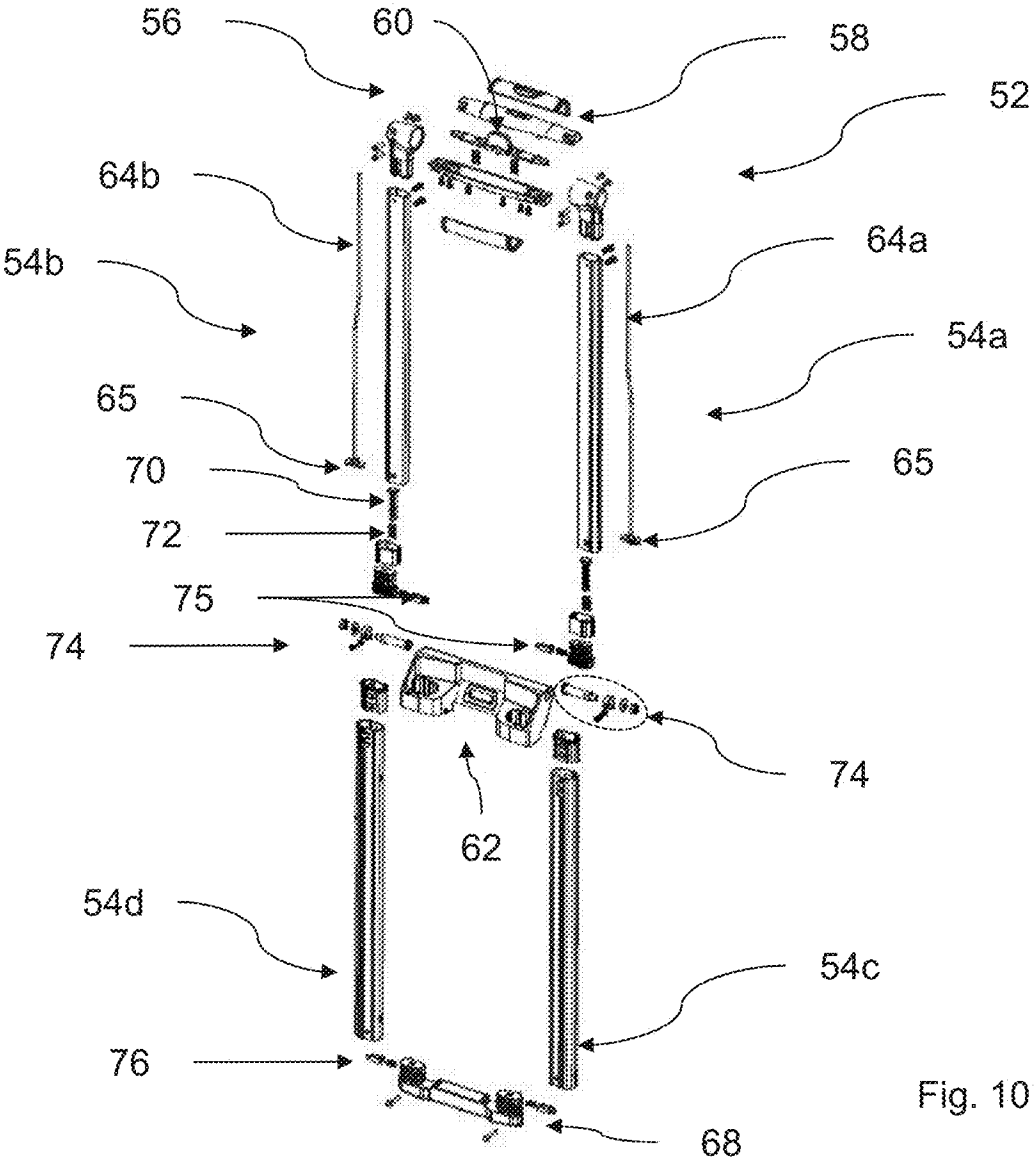

FIG. 10 is an exploded perspective view of a handle portion for a luggage item according to one embodiment of the present disclosure.

Figure 11:
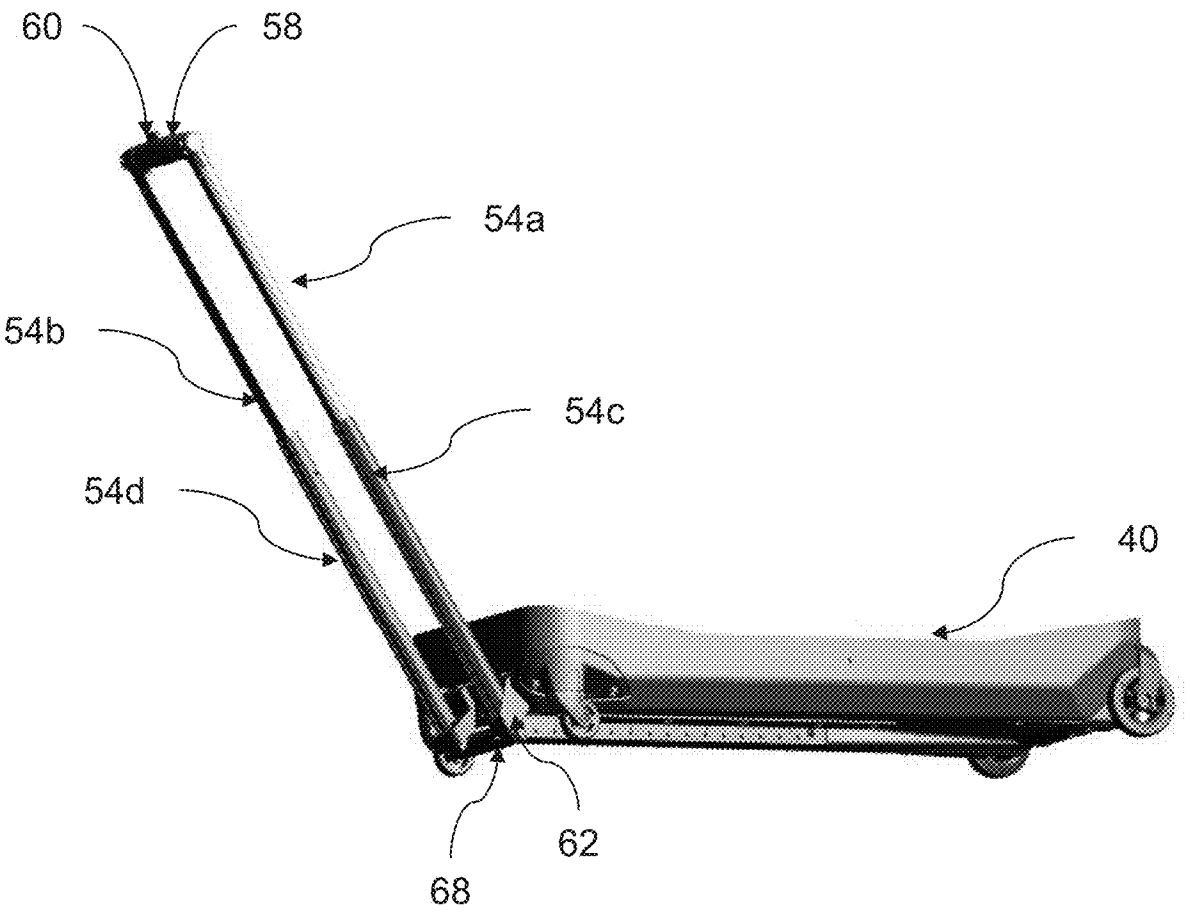

FIG. 11 is a perspective view of portions of a luggage item provided in a second position of use and according to one embodiment of the present disclosure.

Figures 12A, 12B, 12C, 12D:
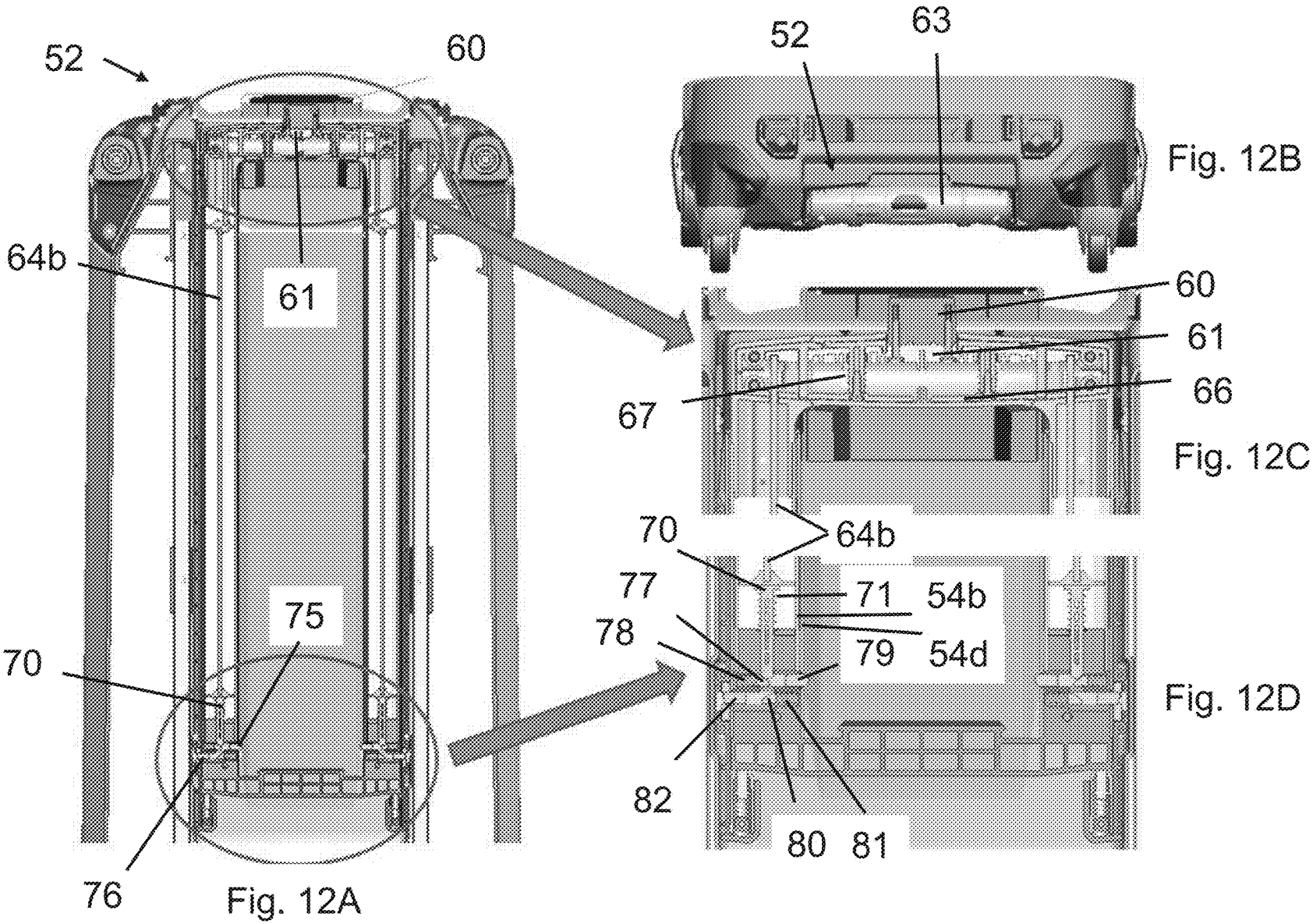

FIG. 12A is a cross-sectional view of a rolling luggage with a handle button in an unextended position and first and second lock features in a locked position.

FIG. 12B is a top plan view of the rolling luggage of FIG. 12A with the handle button in the unextended position.

FIG. 12C is a detailed view of the handle button in FIG. 12A.

FIG. 12D is a detailed view of the first and second lock features in FIG. 12A.

Figures 13A, 13B, 13C, 13D:
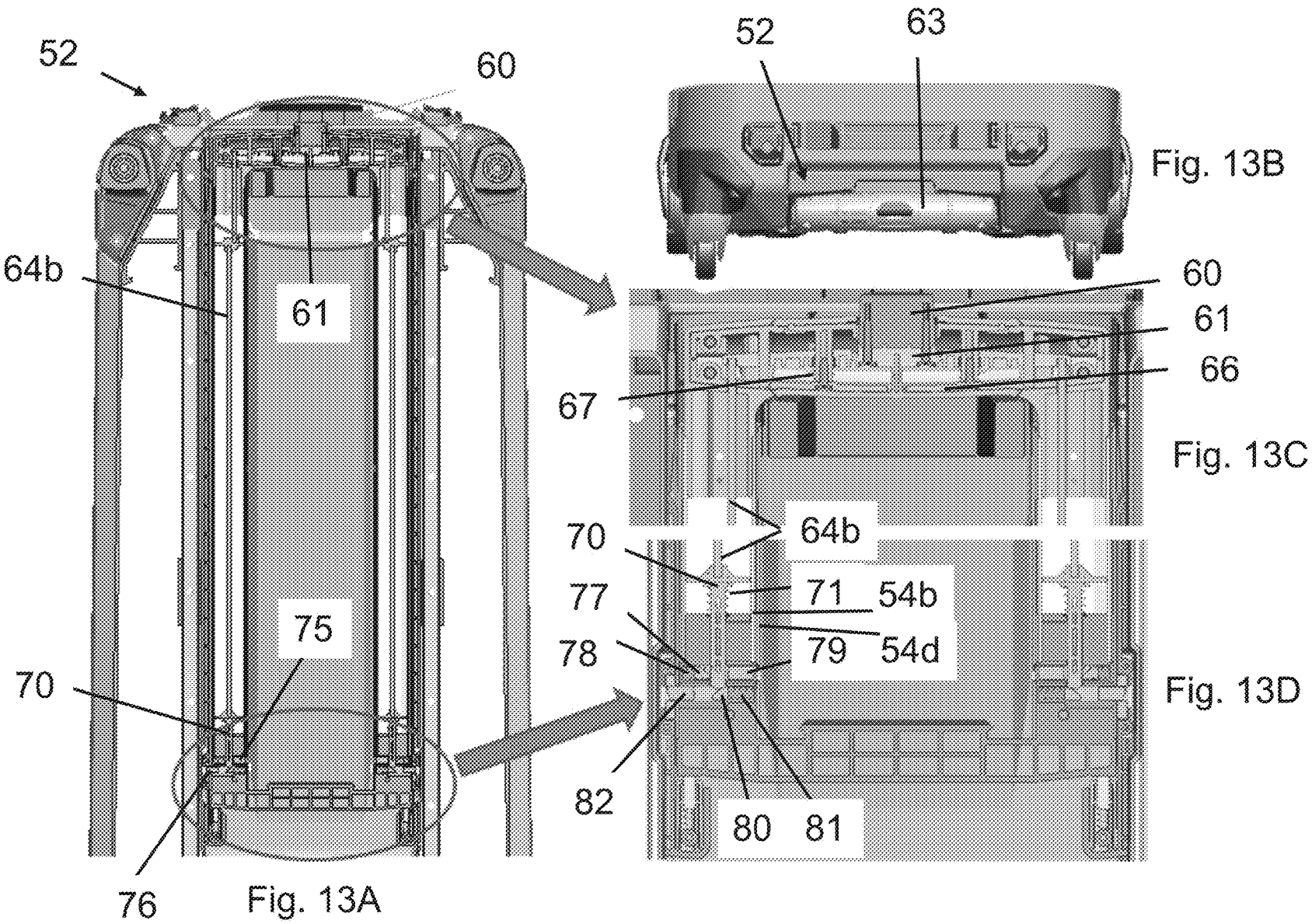

FIG. 13A is a cross-sectional view of a rolling luggage with a handle button extending a first distance, and first lock feature in an unlocked position, and a second lock feature in a locked position.

FIG. 13B is a top plan view of the rolling luggage of FIG. 13A with the handle button extending to the first distance.

FIG. 13C is a detailed view of the handle button in FIG. 13A.

FIG. 13D is a detailed view of the first and second lock features in FIG. 13A.

Figures 14A, 14B, 14C, 14D:
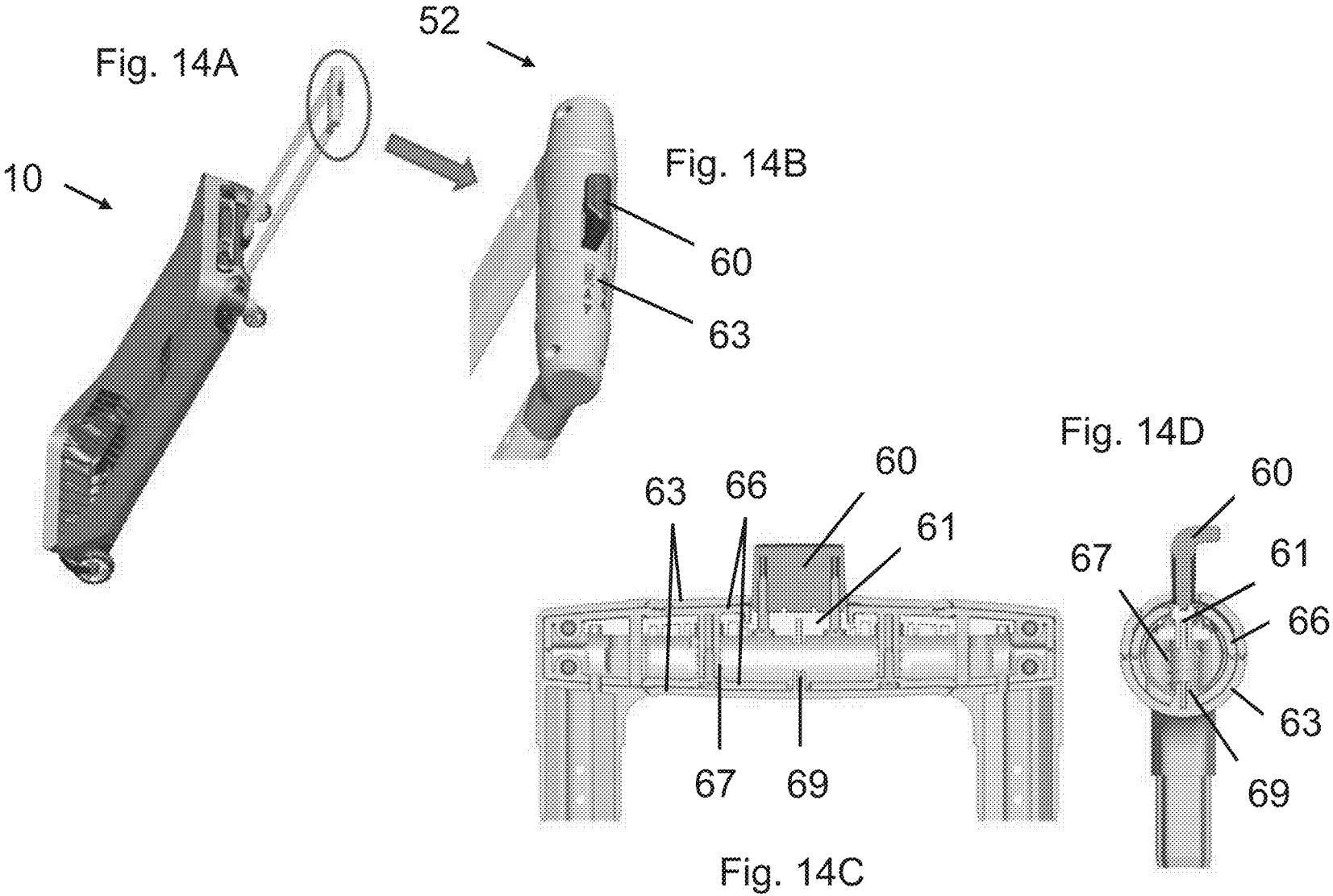

FIG. 14A is a perspective view of a base portion of a rolling luggage and a handle.

FIG. 14B is a detailed view of the handle in FIG. 14A.

FIG. 14C is a cross-sectional view of the handle of the rolling luggage in FIG. 14A showing a handle button in an unextended position.

FIG. 14D is a cross-sectional view of the handle of the rolling luggage in FIG. 14A showing a rotatable portion in a first position to limit extension of the handle button to a first distance.

Figures 15A, 15B, 15C, 15D:
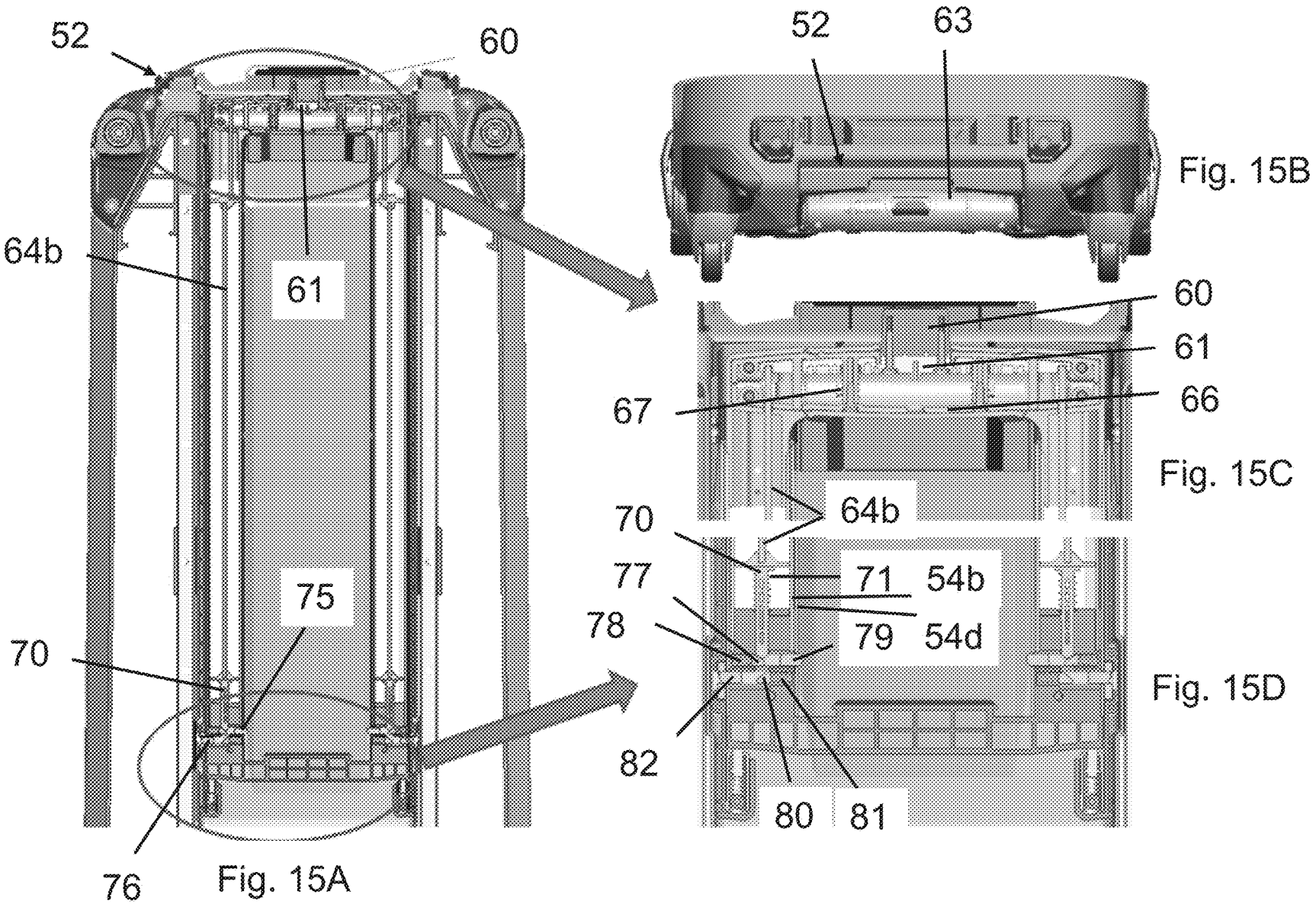

FIG. 15A is a cross-sectional view of a rolling luggage with a handle button in an unextended position and first and second lock features in a locked position.

FIG. 15B is a top plan view of the rolling luggage of FIG. 15A with the handle button in the unextended position.

FIG. 15C is a detailed view of the handle button in FIG. 15A.

FIG. 15D is a detailed view of the first and second lock features in FIG. 15A.

Figures 16A, 16B, 16C, 16D:
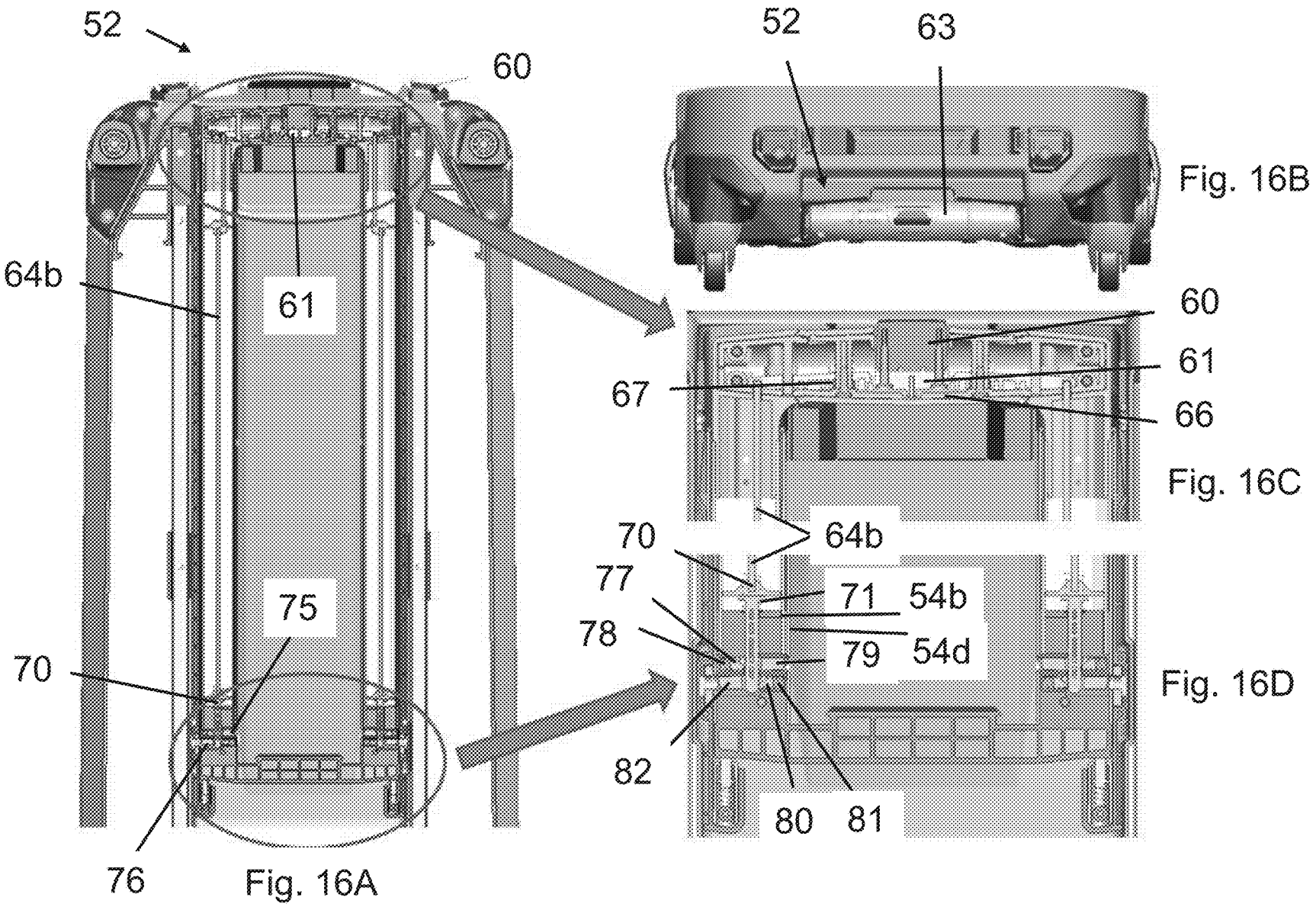

FIG. 16A is a cross-sectional view of a rolling luggage with a handle button extending a second distance, and first lock feature in an unlocked position, and a second lock feature in an unlocked position.

FIG. 16B is a top plan view of the rolling luggage of FIG. 16A with the handle button extending to the second distance.

FIG. 16C is a detailed view of the handle button in FIG. 16A.

FIG. 16D is a detailed view of the first and second lock features in FIG. 16A.

Figures 17A, 17B, 17C, 17D:
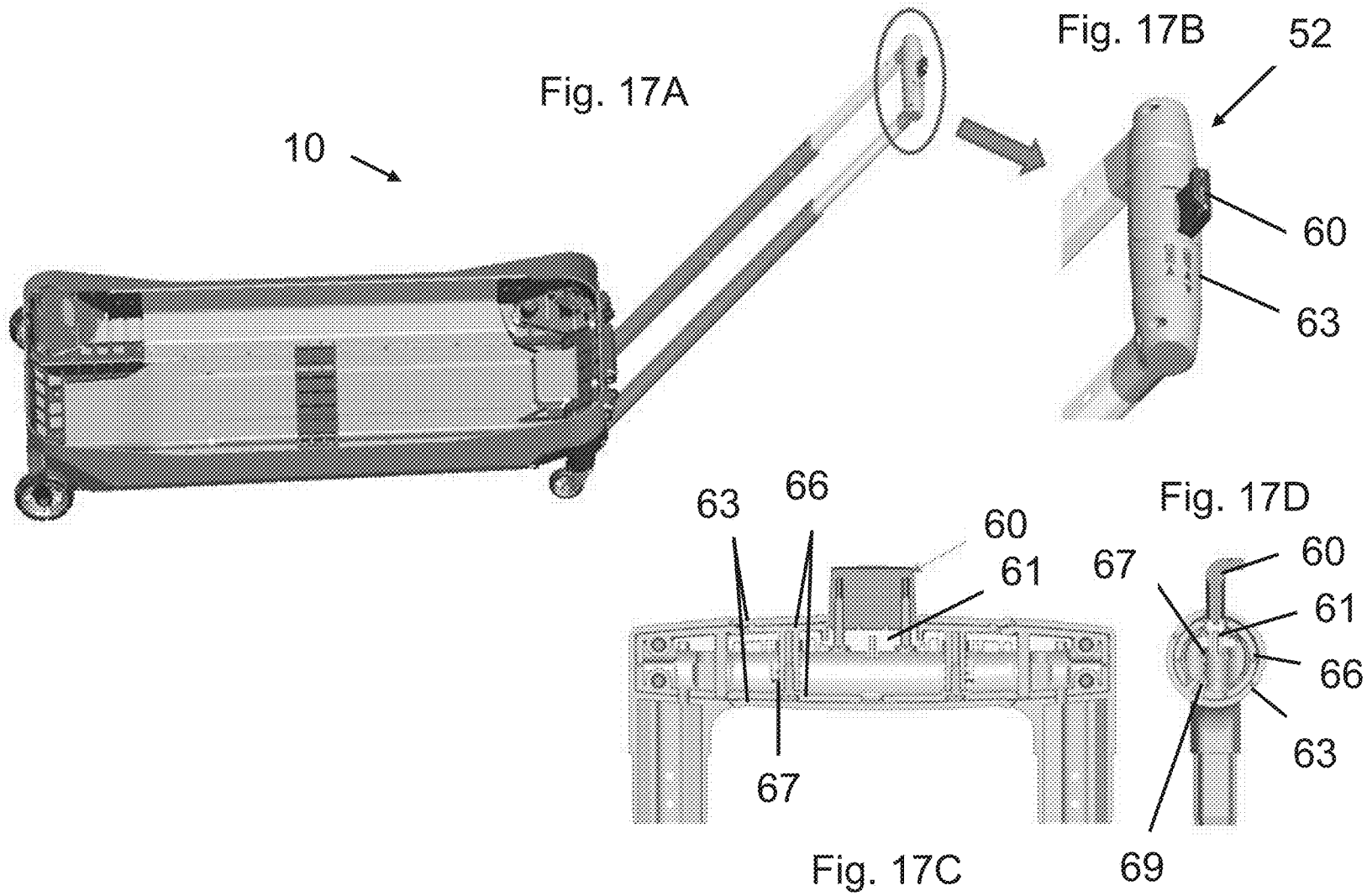

FIG. 17A is a perspective view of a base portion of a rolling luggage and a handle.

FIG. 17B is a detailed view of the handle in FIG. 17A.

FIG. 17C is a cross-sectional view of the handle of the rolling luggage in FIG. 17A showing a handle button in an unextended position.

FIG. 17D is a cross-sectional view of the handle of the rolling luggage in FIG. 17A showing a rotatable portion in a second position to limit extension of the handle button to a second distance.

DETAILED DESCRIPTION

The present invention has significant benefits across a broad spectrum of endeavors. To acquaint persons skilled in the pertinent arts most closely related to the present invention, a preferred embodiment of the method that illustrates the best mode now contemplated for putting the invention into practice is described herein by, and with reference to, the annexed drawings that form a part of the specification. The exemplary method is described in detail without attempting to describe all of the various forms and modifications in which the invention might be embodied. As such, the embodiments described herein are illustrative, and as will become apparent to those skilled in the art, can be modified in numerous ways within the scope and spirit of the invention.

FIG. 1 is a perspective view of a luggage item 2 according to one embodiment of the present invention. As shown, the luggage item 2 comprises a retractable handle member 4, a first pair of wheels 6, a second pair of wheels 8, a base member 10, and a substantially flexible cover portion 12. As shown, the substantially flexible cover portion 12 is interconnected to and extends from the base member 10. The base member 10 and associated cover portion 12 collectively define a storage volume for receiving, storing, and transporting articles. Although various embodiments of the present invention contemplate a substantially flexible cover portion 12, alternative embodiments contemplate articles of rolling luggage of various construction, including full hard-shell rolling luggage units, rolling duffels, expandable rolling units, molded spinner units, wheeled upright units, laptop bags, and various other similar items.

As shown in FIG. 1, the retractable handle member 4 is provided in a position of use that enables the luggage item 2 to be towed, pulled and/or conveyed with both pairs of wheels 6, 8 provided on the ground or floor surface. Such a position may be desirable where the luggage item 2 comprises significant weight, uneven packaging, etc. as this position provides a wider base with greater stability than other positions. FIG. 1 depicts the luggage item 2 in a generally upright position wherein the luggage item 2 is adapted for travel on the first pair of wheels 6 and wherein the second pair of wheels 8 are provided in an elevated position and are not in contact with the ground or floor surface.

In the embodiment of FIG. 1, the first pair of wheels 6 comprise rotatable wheels of a substantially fixed position. The wheels 6 are rotatable about a horizontal axis wherein that axis is provided in a substantially fixed position such that wheels are not provided as "swivel" or castor wheels. In alternative embodiments, the first pair of wheels 6 comprise swivel wheels that are rotatable about a substantially horizontal axis and a substantially vertical axis. The second pair of wheels 8 comprise castor wheels that are rotatable 360 degrees about a substantially vertical axis and are rotatable about a substantially horizontal axis to allow for travel along a ground or floor surface.

The base member 10 is depicted with the retractable handle member 4 extending therefrom and adapted for grasping and pulling by a user. In the depicted embodiment, the retractable handle member 4 comprises two parallel members 15*a*, 15*b* and a connecting member 17. The retractable handle member 4 comprises at least one and preferably two hinge members 16*a*, 16*b* to allow the handle member 4 to hinge between at least a first position and a second position. In various embodiments, and as shown in FIG. 1, a first position comprises a position adapted for transporting the item 2 in an upright position as shown in FIG. 1 and/or retracting the handle member 4 within the base member 10 such as may be desired for storage or stowage of the bag 2. The hinge member 16*a*, 16*b* preferably comprise locking means to secure the handle in the desired first or second position. In certain embodiments, the locking means or mechanism is activated and/or released by a button or control provided on the connecting member 17. In certain embodiments, a single button provided on the connecting member 17 of the handle 4 activates a release that both allows the handle 4 to be retracted and/or extracted and releases the hinge members 16*a*, 16*b*. In other embodiments, separate release buttons or other user-interfaces are provided on the handle 4 to separately control the release of the hinge members 16*a*, 16*b* and retract and/or expand the handle 4.

FIG. 2 is a perspective view of a luggage item according to one embodiment of the present invention in a second position of use. The retractable handle member 4 as shown in FIG. 2 is provided in an extracted state (i.e. with respect to the base member 10) and in an angled position wherein at least a portion of the handle member is angled about a hinge provided on the handle 4.

FIG. 3 is a side elevation view of a luggage item according to one embodiment of the present invention. As shown in FIG. 3, the luggage item 2 of the depicted embodiment comprises a first pair of wheels 6 and a second pair of wheels 8, wherein both pairs of wheels 6, 8 are provided in contact with a ground surface and the luggage item 2 is provided in a generally horizontal position. In the horizontal position, the base member 10 provides support for the device. Preferably, the base member 10 comprises a lightweight and substantially rigid material, such as any one or more plastics suitable for such purposes, that is sufficient to support the bag and moment forces applied in the horizontal position. In various embodiments, and as shown in FIG. 3, the substantially flexible cover portion 12 extends from the base member 10 and surrounds a primary storage volume of the bag 2.

In various embodiments, a first pair of wheels 6 comprise a pair of roller wheels wherein the axis of rotation of the first pair of wheels is substantially fixed. This arrangement allows for the first pair of wheels 6 to comprise a primary set of wheels that are used when the bag is provided in an upright or partially upright position. The second pair of wheels 8 comprises rotatable of pivotable wheels, wherein each axis of each wheel 8 is moveable. Such rotational or pivotal movement of the wheels 8 allows the item 2 to be pulled in the position shown in FIG. 3, and steering is enabled at least in part by the rotation of the wheels 8.

FIGS. 4-5 are perspective views of a retractable handle portion 4 of a luggage item according to one embodiment of the present invention. As shown, the handle portion 4 comprises a collar 20 interconnected to and spanning between first 22*a* and second 22*b* handle members. The base member 10 of the depicted embodiment comprises apertures 24 to receive the elongate first and second 22*a*, 22*b* handle members when the handle 4 is retracted or stowed. The first 22*a* and second 22*b* post-like handle members are translatable with respect to the collar portion 20 and, as shown in FIG. 5, the handle 4 and collar portion 20 are rotatable about an axis 30. Each handle member 22*a*, 22*b* comprises molded stopper members 32 that prevent the handle members from being fully withdrawn from the collar portion.

FIGS. 6A-6B are front and side elevation views of a wheel assembly according to one embodiment of the present invention. As shown, wheels 6 of various embodiments of the present invention comprise minimal housing structures such that the wheels 6 are exposed or useful when the luggage item 2 is provided in at least two different positions. The bag 2 as shown in FIGS. 6A-6B is provided in an upright position. The positioning of the wheels 6 is such that a circumference of the wheel 6 extends beyond the limits or boundary of the main body portion and/or base portion 10 of the bag 2, and such that the wheels 6 extend beyond a first side 30 and a second side 32 of the bag. The positioning of the wheels' axles in such a manner as to allow portions of the wheels 6 to extend beyond limits of the bag 2 allows the bag 2 to be transported or rolled in at least two arrangements as shown and described herein.

FIG. 7 is a rear elevation view of a bag 2 of one embodiment of the present invention. As shown, the bag 2 comprises first 6 and second 8 wheel assemblies. The bag may be transported by rolling on the first wheel assembly 6 only, or may be provided in a second position, sometimes to referred to as "wagon carry", wherein all four wheels 6, 8 are provided in rolling contact with a ground surface.

As shown in FIGS. 8*a*-8*b*, a first pair of wheels 6 is provided at a higher point of gravitational energy than the second pair of wheels 8 when the base member 10 is provided in a horizontal position. Accordingly, when the luggage item 2 is provided in a horizontal arrangement with all four wheels 6, 8 in contact with a ground surface, the luggage item assumes a slightly tilted arrangement wherein a leading portion of the bag proximal the second set of wheels 8 is slightly elevated and the base member 10 extends slightly downwardly toward a rear portion comprising the first pair of wheels 6. In such embodiments, this arrangement allows for ease of use of the luggage item 2 wherein easier access to various features including, for example, the handle 4 is provided.

FIG. 9 is a perspective view of a handle portion and a base portion of a luggage item according to one embodiment of the present disclosure. As shown, a base portion 40 is provided, the base portion comprising a substantially rigid member formed of plastic or similar materials, a lower portion 42 which preferably comprises at least one substantially planar portion 43, and wherein the lower portion 42 is surrounded by a plurality of sidewalls 44. Although not shown in FIG. 9, a flexible portion preferably extends from the sidewalls 44 to provide a rolling duffel structure, wherein an internal storage volume is provided between the base portion 40 and the substantially flexible portion. The base portion 40 comprises a first pair of wheels 46*a*, 46*b* and a second pair of wheels 48*a*, 48*b*. In preferred embodiments, the second pair of wheels 48*a*, 48*b* comprise caster wheels that are rotatable about an axis provided substantially perpendicular to a ground surface.

A handle portion 52 is extendable from the base portion 40 at a first end of the base portion 40. As shown in FIG. 9, the handle portion 52 is transitioning to a second position of use wherein the handle portion 52 is adapted to tow or maneuver the luggage device when the device is disposed on the first and second pairs of wheels 46*a*, 46*b*, 48*a*, 48*b*. In the position shown in FIG. 9, collapsible members 54*a*, 54*b* of the handle portion 52 have been extended or extracted through a bracket member 62. In FIG. 9, the bracket member 62 is provided in a substantially fixed position, both with respect to rotation and other movements. Accordingly, the extended handle portion 52 as shown in FIG. 9 comprises a secure or rigid position that enables movement and manipulation of the luggage device.

Additionally, the base portion 40 comprises a cut-out or angled recess 50 that allows rotation of the handle portion 52 wherein collapsible members 54*a*, 54*b* of the handle portion 52 are allowed to rotate without interference from the base portion 40. The collapsible members 54*a*, 54*b* are translatable through a bracket member 62. The bracket member 62 comprises a selectively rotatable member that enables a rotation of the handle portion 52 as shown and described herein. When unlocked, the bracket member 62 is rotatable about an axis that extends substantially parallel to an axis extending through the wheels 46*a*, 46*b* and substantially perpendicular to the collapsible members 54*a*, 54*b*. The rotation of the bracket member 62 enables rotation of the handle member 52 and conversion between first and second positions of use. In the embodiment provided in FIG. 9, the collapsible members 54*a*, 54*b* are provided in tracks or slots 49 extending along a portion of the base member 40 to help guide movement of the collapsible members. The bracket member 62 is provided adjacent or proximal to the slots 49, and rotation of the bracket member 62 is not restricted by the slots 49.

The handle portion 52 comprises a grasping member 56, which generally comprises an elongate member adapted for communication with a hand of a user to manipulate and maneuver an associated luggage item. The grasping member 56 is provided substantially perpendicular to the collapsible members 54*a*, 54*b*, and extends between the two collapsible members. In addition to providing a user-interface and a point of contact for a user to grasp the handle, the grasping member 56 also comprises at least one control feature for converting the handle member 52 between at least two positions of use. Specifically, embodiments of the present disclosure contemplate that the handle portion 52 is extendable between a retracted, stored position and at least two extended positions of use. The at least two positions of use comprise a first extended position wherein the device is provided for rolling or conveyance on the first pair of wheels 46*a*, 46*b*, and a second extended position wherein the handle portion 52 is provided at an angle to the base portion 40 and the device is adapted for rolling or conveyance on both pairs of wheels 46*a*, 46*b*, 48*a*, 48*b*. To enable the conversion between the retracted position, the first extended position, and the second extended position, the grasping portion 56 comprises a first control member 58 and a second control member 60. In the depicted embodiment, the first control member 58 comprises a rotatable portion of the handle that is rotatable about the longitudinal axis of the grasping member 56. The second control member, as shown in FIG. 9, comprises a push-button adapted for use in conjunction with the first control member. In contrast with known devices, which generally provide for a single release feature to enable selective extension of a collapsible handle, embodiments of the present disclosure provide for a selectively extendable handle that comprises at least one additional control member to convert the handle between a first extended position and a second extended position.

As shown in FIG. 9, a bracket member 62 is provided. The bracket member 62 comprises a selectively rotatable portion having first and second apertures for receiving the collapsible members 54*a*, 54*b* of the handle portion 52 and wherein the collapsible members 54*a*, 54*b* are translatable through the rotatable bracket 62 along at least a portion of the lengths of the collapsible members 54*a*, 54*b*. To convert the handle portion 52 from a first position of use to a second position of use wherein the handle portion 52 is rotated and provided at an angle with respect to the base portion 40, a control mechanism is activated and allows the rotatable bracket 62 and the handle portion 52 to rotate. The base portion 40 comprises an aperture, a cut-out, or recess 50 to enable this rotation. In preferred embodiments, an angled recess 50 is provided in the base portion to enable and/or limit rotation of the rotatable bracket 62 and the handle portion 52.

FIG. 10 is an exploded perspective view of the handle portion 52 of the embodiment of FIG. 9. As shown, the handle portion 52 comprises a grasping portion 56 provided at one end of first and second collapsible members 54*a*, 54*b*. The collapsible members 54*a*, 54*b* extend through a selectively rotatable bracket member 62. A second bracket member 68 is provided at a second end of the handle member, generally opposite from the grasping portion 56. When assembled, the handle member comprises a grasping portion 56 on a first end of the collapsible members 54, 54*b* and a second bracket at an opposed second end of the collapsible members. The handle is translatable between a stored position wherein the grasping portion is provided proximal to the bracket portion 62, and an extended position wherein the second bracket member 68 is brought into contact with the bracket member 62.

In various embodiments, the present disclosure contemplates a handle portion 52 comprising elongate rod members 64*a*, 64*b* extending along and preferably internal to the collapsible members 54*a*, 54*b* and wherein the collapsible members 54*a*, 54*b* comprise elongate tubular members. The elongate rod members 64*a*, 64*b* comprise force-transmitting means provided to convert a force or movement applied to the push-button 60 on grasping portion 56 to additional features. The rod members 64*a*, 64*b* act upon locking pins to manipulate the locking pins and selectively lock and unlock the collapsible members so that they may be extended or retracted based on a user preference. Additionally, and depending upon a position of a rotatable portion 58 of the grasping portion 56, a movement of the push-button and the rod members unlocks a rotation of the bracket member 62 to enable rotation of the handle member 52 and allows the handle member 52 to be provide in an angled position.

As shown in FIG. 9, the rotatable bracket member 62 is provided proximal to a first end of the base portion 40. The bracket member 62 is preferably fixed in a lateral and longitudinal direction and rotatable about an axis. In other words, the rotatable bracket 62 is selectively rotatable with respect to the base portion 40, but is otherwise in a fixed relative position with respect to the base portion 40. The second bracket member 68 is substantially fixed to a second end of the collapsible members 54*a*, 54*b* and translates with the collapsible members between a stored position and an extended position wherein the second bracket member 68 is brought into contact with the rotatable bracket member 62.

In the depicted embodiment, a handle portion 52 is provided wherein a grasping portion 56 comprises a rotatable portion 58 that is rotatable between at least a first and second position. The rotational position of the rotatable portion 58 dictates or governs the overall displacement of distal ends 65 of the rod members 64. When the rotatable portion 58 is provided in a first position, a depression of the push-button 60 extends the rod members 64 to a first predetermined position. The first predetermined position corresponds to unlocking a first locking member that allows the collapsible members 54*a*, 54*b* to extend, but does not allow for or unlock rotation of the bracket 62 and a rotational position of at least the rotating bracket 62 remains substantially fixed. Thus, even when the handle portion 52 is extracted or expanded to a first position of use, the handle portion 52 and collapsible members 54*a*, 54*b* are provided substantially parallel to at least a planar portion 43 of a base portion 40 and the luggage device is adapted to be towed, wheeled, manipulated, etc. on the first pair of wheels 46*a*, 46*b*.

When the rotatable portion 58 of the grasping portion 56 is rotated to a second position, depression of the push button enables extension of the collapsible members 54*a*, 54*b* and unlocks additional locking members to enable rotation of the bracket 62 such that the handle portion 52 may rotate to an angled position with respect to at least the planar portion 43 of the base 40. In various embodiments, the angled position of the handle portion 52 comprises an angle with respect to the planar portion 43 and/or ground or floor surface of between approximately 20 degrees and approximately 80 degrees. In preferred embodiments, the angled position of the handle portion 52 comprises an angle with respect to the planar portion 43 and/or ground or floor surface of between approximately 40 degrees and approximately 50 degrees, and most preferably of approximately 45 degrees. It is contemplated that the planar portion 43, and a plane extending therefrom, comprises a surface that is substantially parallel to a ground or floor surface when each of the two pairs of wheels are provided in contact with the ground or floor surface. It will be recognized, however, that the planar portion 43 of the base portion 40 need not be exactly parallel to the ground surface. Indeed, the orientation of the planar portion 43 and a ground surface may vary based on contours provided in the base portion 40, relative sizes of the opposing pairs of wheels, etc.

Referring to FIG. 10, various unlocking features are shown in an exploded state. As shown a grasping portion 56 comprises a rotatable portion 58 and a push button 60. The rotatable portion 58 is rotatable between at least a first position and a second position. The first position enables a displacement of the rod members 64*a*, 64*b* by a first amount. The second position enables a displacement of the rod members 64*a*, 64*b* by a second amount, and wherein the second amount is greater than the first. A depression of the push button 60 induces a linear movement of the elongate rod members 64*a*, 64*b*. The second ends of the rod members 64*a*, 64*b* comprise push boards 65. The push boards 65 are provided in the form of flanges or other extensions adapted to transmit a force from the rod members 64*a*, 64*b* to unlock various locking elements, such as one or more lock pins. The one or more lock pins are displaceable in a direction substantially perpendicular to a longitudinal axis of the collapsible members and the rod members. In various embodiments, a cammed or ramped surface is provided to convert a linear motion of the rod members in a first direction to a linear motion of the lock pins in a second, substantially perpendicular direction. The lock pins are moveable in and out of rigid portions of the bag, such movement corresponding to a locking and unlocking motion of the handle member 52 and/or the bracket 62.

In one embodiment, a device is provided wherein a first rotational position of the rotatable portion 58 of the grasping member 56 comprises a position wherein the push-button 60 and rotatable portion 58 are provided in a first position, and the push-button 60 preferable extends upwards as in conventional devices. In such a position, activation or depression of the push button unlocks first lock pins 75 associated with extension of the handle 52. The lock pins 75 are preferably biased toward a locking position by a coil spring or similar member.

As shown in FIG. 10, a second bracket 68 comprises biased locking pins 76 that are adapted to secure the second bracket 68 and the handle 52 in a stored position and to engage the rotatable bracket 62 in an extended position and when desired by a user. In addition or alternatively, the locking pins 76 are positioned in the second pair of members 54*c*, 54*d*, and the locking pins 76 selectively secure the second pair of members 54*c*, 54*d* and the second bracket 68 relative to the base member.

The rotatable bracket 62 comprises first and second axles 74 that enable rotation of the rotatable bracket 62 when associated lock pins are released. In various embodiments, a single axle may extend through the bracket 62 and be provided in communication with a luggage device. The axles 74 may be biased by one or more springs to bias or urge the bracket 62 to a first or second position.

In the embodiment provided in FIG. 10, the collapsible members 54 comprise a first pair of members 54*a*, 54*b* and a second pair of members 54*c*, 54*d*. The first pair of members 54*a*, 54*b* extend or telescope outwardly from the second pair of member 54*c*, 54*d* when two-wheeled carry is desired. The second pair of members 54*c*, 54*d* and the second bracket 68 provided on a distal end of the second pair of members 54*c*, 54*d* remain substantially fixed when the grasping member 56 and first pair of collapsible members 54*a*, 54*b* are extended to a first position of use. In a second position of use, the first pair of members 54*a*, 54*b* are extended with respect to the second pair of members. Additionally, the second pair of members 54*c*, 54*d* are extended with respect to the bag such that the second bracket 68 is brought into communication with the rotatable bracket 62. The second position thus comprises a greater overall extended handle 52 length as the first position. A stored or collapsible position comprises the first pair of collapsible members 54*a*, 54*b* being collapsed or extending into the second pair of members 54*c*, 54*d* and both pairs being retracted such that the grasping portion 56 of the handle is provided proximal to the base portion 40 of a luggage item.

To extend a first pair of collapsible members 54*a*, 54*b* and the grasping portion 56 to a first position of use, the rotatable portion 58 of the grasping portion 56 is provided in a first position. The push button 60 is depressed, which extends the rod members 64*a*, 64*b* and associated push boards 65 by a first distance. The push boards 65 act upon push pins 70, and cause an unlocking of a first pair of lock pins 75. The unlocking of the first pair of lock pins 75 enables the first pair of collapsible members 54*a*, 54*b* to extend upwardly with respect to other features of the bag, and the bracket 62 and second pair of collapsible members 54*a*, 54*b* remain substantially unmoved and unaffected. This unlocking motion allows the grasping portion 56 to be extended upwardly to a first position of use wherein the first lock pins 75 are preferably biased outwardly to temporarily lock the handle portion in the first position of use.

To extend the handle 52 to a second position of use, the rotatable portion 58 of the handle is rotated to a second position. This rotation of the rotatable portion 58 allows the rod members 64*a*, 64*b* and associated push boards 65 to extend by a second distance. In the depicted embodiment, the second distance is greater than the first distance. The movement of the push board 65 by the second distance causes an unlocking of the first pair of lock pins 75 as described above and further causes a similar unlocking action of a second pair of lock pins 76 provided in association with the second bracket 68. The second bracket 68 and second pair of collapsible members 54*c*, 54*d* are thus allowed to extend upwardly, and the second bracket 68 is brought into contact with the rotatable bracket 62. Without the second pair of lock pins 76 preventing rotation of the bracket 62, the entire handle and bracket 62 are allowed to rotate to an angle that enables the device to be towed an all four wheels. The first pair of collapsible members 54*a*, 54*b* are also allowed to telescope or extend outwardly from the second pair of collapsible members 54*c*, 54*d*.

FIG. 11 is a perspective view showing the base portion 40 provided in a second position of use wherein four-wheeled carry or movement of the device is enabled. As described herein, telescoping collapsible members 54*a*, 54*b*, 54*c*, 54*d* are extended with respect to each other and with respect to the base portion 40. The second bracket 68 is brought into contact with the rotatable bracket 62, and the handle 52 is rotated to an angle that allows a user to manipulate the handle 52 and associate luggage item when the base position 40 is provided with all four wheels in contact with a ground surface.

Although FIGS. 9-11 of the present disclosure provide a device with a pair of substantially parallel collapsible members, alternative embodiments contemplate a handle portion comprising a single telescoping or collapsible member. For example, a single collapsible may be provided in combination with the features shown and described herein including, for example, the rotatable bracket 62. The single collapsible member may be centered on the base portion, or provided in any number of desired orientations. The single collapsible member may include, for example, a grasping portion similar to that shown and described herein and extending laterally away from the collapsible member in two directions.

Now referring to FIGS. 12A-12D, various views of a rolling luggage with all collapsible members or stays in a retracted and locked state are provided. As shown in FIG. 12A, the rolling luggage has a handle 52 with a button 60 that a user can depress or extend to selectively unlock collapsible members 54 and convert the rolling luggage between modes of operation, for example, from a retracted state to a two-wheel mode or from a retracted state to a four-wheel mode. A button member 61 is positioned underneath the button 60, and the button member 61 translates linear motion of the button 60 to rods 64 that extend downward through the collapsible members 54. The rods 64 translate linear motion to lock pins 70 positioned at distal ends of the rods 64. Then, the lock pins 70 selectively engage and unlock only a first lock feature 75 to convert the rolling luggage from a retracted state to a two-wheel mode of operation, or unlock the first lock feature 75 and a second lock feature 76 to convert the rolling luggage from a retracted state to a four-wheel mode of operation.

As shown in FIG. 12B, a rotating portion 63 of the handle 52 toggles between a first position and a second position that represent a two-wheel mode and a four-wheel mode, respectively, and the rotating portion 63 is depicted in the first position. As shown in FIG. 12C, the button 60 connects to a button portion 61, and the button portion 61 can move linearly within a non-rotating portion 66 of the handle as the button 60 is depressed or extends to a first or second distance. At least one spring 67 may be positioned between the button portion 61 and the non-rotating portion 66 to bias the button portion 61 and the button 60 upward in a non-depressed or non-extended position.

As shown in FIG. 12D, the lock pin 70 may be an associated spring 71 that biases the lock pin 70 upward and against a portion of a first or inner collapsible member 54*b*, which is nested within a second or outer collapsible member 54*d*. Next, the first lock feature 75 from FIG. 12A has a chamfer portion 77 with an associated spring 78 that biases the chamfer portion 77 to the inward or righthand direction in this instance. The chamfer portion 77 translates a vertical motion of the pin 70 to a horizontal motion. A detent 79 is connected to the chamfer portion 77 and moves horizontally in an outward or lefthand direction when the pin 70 of the rod 64 or force transmitting member extends downwardly against the chamfer portion 77. In a default or retracted state, the detent 79 extends through an aperture in the first collapsible member 54*b* and an aperture in the second collapsible member 54*d* to secure the members 54*b*, 54*d* together. When the detent 79 moves in the lefthand direction, the detent 79 moves out of the aperture of the second collapsible member 54*d*, allowing the first collapsible member 54*b* to move relative to the second collapsible member 54*d*. The detent 79 may reenter a second aperture at a second location on the second collapsible member 54*d* to selectively lock the first member 54*b* in an extended position relative to the second member 54*d*, or reenter the first aperture on the second collapsible member 54*d* to revert to the original or retracted arrangement of the collapsible members 54*b*, 54*d*.

Similarly, the second lock feature 76 from FIG. 12A has a chamfer portion 80 with an associated spring 81 that biases the chamfer portion 80 to the outward or lefthand direction in this instance, which is opposite of the first or top chamfer 77 and detent 79. A detent 82 moves in the inward or righthand direction, overcoming the spring bias, when the lock pin 70 extends through the first lock feature 75 and contacts the chamfer portion 80. Here, the detent 82 extends through an aperture in the second or outer collapsible member 54*d* and a portion of the rolling luggage that is adjacent or proximate to the collapsible members 54*b*, 54*d* such as the base. With this detent 82 retracted, the second collapsible member 54*d* can move relative to the body of the rolling luggage. Once the second collapsible member 54*d* clears a channel or other portion of the body of the rolling luggage, the collapsible members 54 can then rotate about an axis such that all four wheels of the luggage are positioned on a ground surface, and a user may grasp the handle to tow the luggage.

Now referring to FIGS. 13A-13D, various views of a rolling luggage with first or inner collapsible members or stays in an unlocked state and second or outer collapsible members or stay in a retracted and locked state are provided. As shown in FIG. 13D, the button 60 is depressed to a first position and first distance, which moves the button member 61 and the rods 64 by a first distance. The lock pin 70 contacts the chamfer portion 77, which causes the chamfer portion 77 to overcome the spring bias and move to the left. This causes the detent 79 to move out of engagement with the aperture in the second or outer collapsible member 54*d*. However, the lock pin 70 does not contact the other chamfer 80, and the first lock feature 75 remains locked. Then, the user can pull upward on the handle 52 to extend the first collapsible members 54 upward from the second collapsible members 54 and the luggage, and the first collapsible members 54 selectively lock into another aperture in the second collapsible members 54. In this mode, the user can tow the luggage on two wheels.

Now referring to FIGS. 14A-14D, various views of a rolling luggage with a handle having a rotating portion 63 limiting extension of a button 60 to a first distance are provided. FIGS. 14A and 14B show the rotating portion 63 of the handle 52 toggled to a first position or two-wheel mode of operation. FIGS. 14C-14D show how the rotating portion 63 limits the extension of the button 60 to unlock only the first lock feature and not the second lock feature. As previously described, the rotating portion 63 of the handle 52 is positioned outside of a non-rotating portion 66 of the handle 52. The rotating portion 63 rotates between (i) a first position or two-wheel mode of operation where the button 60 can extend a first distance to unlock only the first lock feature and (ii) a second position or four-wheel mode of operation where the button 60 can extend to a second, larger distance to unlock both the first and second lock features. As shown in FIGS. 14C and 14D, a stop 69 on the rotating portion 63 obstructs the travel of the button member 61 when the button 60 is depressed. Specifically, the stop 69 limits the button member 61 and the button 60 to the first distance. This causes the rods 64 and pins 70 to extend so far as to only unlock the first lock feature 75 as shown in FIGS. 13A-13D.

Now referring to FIGS. 15A-15D, various views of a rolling luggage with all collapsible members or stays in a retracted and locked state are provided. As shown in FIG. 14B, the rotating portion 63 of the handle 52 has now been toggled to a second position or a four-wheel mode.

Now referring to FIGS. 16A-16D, various views of a rolling luggage with first or inner and second or outer collapsible members or stays in an unlocked state are provided. The button 60, button member 61, rods 64, and pins 70 have been depressed and extended by a second distance, which is larger than the first distance described above. As shown in FIG. 16D, the pin 70 contacts both chamfer portions 77, 81 to unlock both lock features 75, 76. This unlocking allows the first or inner collapsible member 54*b* to move upward relative to the second or outer collapsible member 54*d* to a second or extended position. In addition, this unlocking allows the second or outer collapsible member 54*d* to move relative to the body of the luggage to a point where the second or outer collapsible member 54*d*, and thus, the first or inner collapsible member 54*b* to rotate relative to the body like or similar to what is shown in FIG. 11, and the user can tow the luggage on all four wheels.

Now referring to FIGS. 17A-17D, various views of a rolling luggage with a handle are provided. These figures show how toggling the rotating portion 63 to a second position allows the button 60 to extend by the second, larger distance. As shown in FIG. 17D, the stop 69 has rotated to the side, which provides additional clearance for the button member 61. Thus, when the user depresses the button 60, the button 60 and other force transmitting features 61, 64, 70 extend downward by a larger second distance to unlock both lock features. As shown, the button member 61 may have a downward extending protrusion that engages the stop 69 in the first position but then does not engage the stop 69 in the second position to provide additional clearance for the button member 61.

While various embodiments of the present invention have been described in detail, it is apparent that modifications and alterations of those embodiments will occur to those skilled in the art. However, it is to be expressly understood that such modifications and alterations are within the scope and spirit of the present invention. Further, the invention(s) described herein are capable of other embodiments and of being practiced or of being carried out in various ways. In addition, it is to be understood that the phraseology and terminology used herein is for the purposes of description and should not be regarded as limiting. The use of "including," "comprising," or "adding" and variations thereof herein are meant to encompass the items listed thereafter and equivalents thereof, as well as, additional items.

What is claimed is:

1. An article of rolling luggage, comprising:

a substantially rigid base portion having a plurality of wheels;

a substantially flexible cover portion secured to the base portion, the base portion and the cover portion defining a storage volume of the article;

a handle assembly having a bottom member, a top member at least partially positioned in the bottom member, and a handle connected to the top member, wherein the handle and top member are translatable between a retracted position and an extended position relative to the bottom member, and wherein the handle assembly is translatable between a non-rotatable position and a rotatable position relative to the base portion such that the handle assembly can rotate about an axis relative to the base portion when the handle assembly is in the rotatable position;

a top lock feature connected to the top member and configured to unlock only the top member from the bottom member so the top member and the handle can translate between the retracted position and the extended position;

a bottom lock feature connected to the bottom member and configured to unlock the handle assembly from the base portion so the handle assembly can translate between the non-rotatable position and the rotatable position; and a control member provided on the handle, the control member provided in force transmitting communication with the top lock feature and the bottom lock feature, wherein the control member comprises a push-button, and wherein in a first mode the push-button extends a first distance which causes only the top lock feature to unlock, and in a second mode the push-button extends a larger second distance which causes the top lock feature and the bottom lock feature to unlock.

2. The article of rolling luggage of claim 1, further comprising:

a button member positioned in the handle, and the button member connected to the push-button;

a rod positioned in the top member, and an upper end of the rod connected to the button member;

a push board connected to a lower end of the rod; and a push pin connected to the push board, wherein, when the push-button extends the first distance, the push pin extends the first distance and contacts the top lock feature to unlock only the top lock feature, and wherein, when the push-button extends the second distance, the push pin extends the second distance and contacts the top lock feature and the bottom lock pin to unlock the top lock feature and the bottom lock feature.

3. The article of rolling luggage of claim 2, further comprising a spring positioned between the button member and a non-rotating portion of the handle to bias the button member and the push-button to an unextended position.

4. The article of rolling luggage of claim 1, wherein, in the second mode, the control member unlocks the top lock feature and the bottom lock feature when the handle and top member are in the retracted position.

5. The article of rolling luggage of claim 1, wherein the handle has a rotating portion having a stop extending inward toward a rotation axis of the rotating portion, wherein when the rotating portion is rotated to a first position and the control member extends the first distance before contacting the stop, and wherein when the rotating portion is rotated to a second position, the stop is rotated out of a path of the control member, and the control member extends the larger second distance.

6. The article of rolling luggage of claim 1, wherein the bottom lock feature remains locked in the first mode.

7. The article of rolling luggage of claim 1, further comprising:

a slot defined by the base portion, wherein the bottom member is positioned in the slot in the non-rotatable position, and the bottom member is positioned out of the slot in the rotatable position.

8. An article of rolling luggage comprising:

a substantially rigid base portion having a plurality of wheels;

a substantially flexible cover portion secured to the base portion, the base portion and the cover portion defining a storage volume of the article;

a retractable handle assembly provided in communication with the base portion for towing the article of rolling luggage, the retractable handle assembly having:

a bottom member, a top member at least partially positioned in the bottom member, a handle connected to the top member, and a rod positioned in the top member, wherein the top member has a top lock feature that selectively unlocks so that the top member can move relative to the bottom member, and the bottom member has a bottom lock feature that selectively unlocks so that the bottom member can move relative to the base portion; and a push button and a rotatable portion of the handle, wherein the push button is operably connected to an upper end of the rod, and a lower end of the rod is positioned above the top lock feature and the bottom lock feature, wherein, in a first position of the rotatable portion, the rotatable portion obstructs depression of the push button and the rod to a first length to unlock the top lock feature, and in a second position of the rotatable portion, the rotatable portion does not obstruct depression of the push button and the rod, which extend a larger second length to unlock the top lock feature and the bottom lock feature.

9. The article of rolling luggage of claim 8, wherein the handle and the top member are configured to move between a retracted position and an extended position relative to the bottom member when the top lock feature is unlocked, and wherein the bottom member is configured to move between a non-rotatable position and a rotatable position relative to the base portion when the bottom lock feature is unlocked.

10. The article of rolling luggage of claim 9, wherein in the rotatable position, the retractable handle assembly rotates about an axis relative to the base portion.

11. The article of rolling luggage of claim 8, wherein a stop of the rotatable portion obstructs the push button in the first position, and the stop of the rotatable portion does not obstruct the push button in the second position.

12. The article of rolling luggage of claim 8, wherein the top lock feature has a top chamfer portion and a top detent that deflect in a direction that is perpendicular to the travel of the rod when the rod contacts the top chamfer portion such that the top detent exits an aperture of the bottom member, and the top member moves between a retracted position and an extended position relative to the bottom member.

13. The article of rolling luggage of claim 12, wherein the bottom lock feature has a bottom chamfer portion and a bottom detent that deflect in a direction opposite of the top chamfer portion and the top detent when the rod contacts the bottom chamfer portion such that the bottom detent exits an aperture of the base portion, and the retractable handle assembly moves between a non-rotatable position and a rotatable position relative to the base portion.

14. The article of rolling luggage of claim 13, wherein the rod has a push board and a push pin, wherein the push pin is configured to contact the top chamfer portion and the bottom chamfer portion.

15. An article of rolling luggage comprising:

a substantially rigid base portion having a plurality of wheels;

a substantially flexible cover portion secured to the base portion, the base portion and the cover portion defining a storage volume of the article of rolling luggage;

a retractable handle assembly provided in communication with the base portion for towing the article of rolling luggage, the retractable handle assembly having:

a bottom member;

a top member at least partially positioned in the bottom member, wherein the bottom member and the top member are oriented in a longitudinal direction;

a handle connected to the top member;

a push button provided on the handle;

a top lock feature positioned in the top member, wherein the top lock feature has a top chamfer and a top detent configured to move in a direction perpendicular to the longitudinal direction, wherein the top lock feature is in force transmitting communication with the push button;

a bottom lock feature positioned in the bottom member, wherein the bottom lock feature has a bottom chamfer and a bottom detent configured to move in a direction opposite of the top chamfer and detent, wherein the bottom lock feature is in force transmitting communication with the push button;

wherein, in a first mode of operation, extension of the push button by a first distance causes the top chamfer and the top detent to move out of an aperture in the bottom member to unlock the top lock feature; and wherein, in a second mode of operation, extension of the push button by a larger second distance causes the bottom chamfer and the bottom detent to move out of an aperture in the base portion to unlock the bottom lock feature.

16. The article of rolling luggage of claim 15, wherein unlocking the top lock feature unlocks the top member from the bottom member so that the handle and the top member can translate between a retracted position and an extended position relative to the bottom member, and wherein unlocking the bottom lock feature unlocks the bottom member from the base portion so that the retractable handle assembly can rotate between a non-rotatable position and a rotatable position relative to the base portion.

17. The article of rolling luggage of claim 16, wherein the top chamfer and the top detent extend into a second aperture in the bottom member to secure the top member in the extended position relative to the bottom member.

18. The article of rolling luggage of claim 15, further comprising:

a rod positioned in the top member, wherein extension of the push button extends the rod, and the rod contacts at least one of the top chamfer or the bottom chamfer.

19. The article of rolling luggage of claim 15, wherein the handle has a rotating portion with a stop that obstructs the push button in the first mode to limit the push button to the first distance, and the stop does not obstruct the push button in the second mode such that the push button extends to the larger second distance.

* * * * *